US010980314B2

(12) United States Patent
Walker et al.

(10) Patent No.: US 10,980,314 B2
(45) Date of Patent: Apr. 20, 2021

(54) INCLINE ADJUSTER WITH MULTIPLE DISCRETE CHAMBERS

(71) Applicant: NIKE, Inc., Beaverton, OR (US)

(72) Inventors: Steven H. Walker, Camas, WA (US); Raymond L. Nicoli, Seattle, WA (US); Rolando Pausal, Kirkland, WA (US)

(73) Assignee: NIKE, Inc., Beaverton, OR (US)

( * ) Notice: Subject to any disclaimer, the term of this patent is extended or adjusted under 35 U.S.C. 154(b) by 0 days.

(21) Appl. No.: 16/118,890

(22) Filed: Aug. 31, 2018

(65) Prior Publication Data

US 2019/0059514 A1 Feb. 28, 2019

Related U.S. Application Data

(60) Provisional application No. 62/552,551, filed on Aug. 31, 2017.

(51) Int. Cl.
*A43B 13/18* (2006.01)
*A43B 13/12* (2006.01)
(Continued)

(52) U.S. Cl.
CPC ..... *A43B 13/189* (2013.01); *A43B 3/0005* (2013.01); *A43B 3/246* (2013.01);
(Continued)

(58) Field of Classification Search
CPC ..... A43B 7/189; A43B 7/20; A43B 7/206; A43B 7/38; A43B 7/1425; A43B 7/1435;
(Continued)

(56) References Cited

U.S. PATENT DOCUMENTS 3,906,185 A 9/1975 Gross et al.
4,183,156 A 1/1980 Rudy
(Continued)

FOREIGN PATENT DOCUMENTS

DE 10240530 A1 3/2004
EP 2774502 A1 9/2014
(Continued)

OTHER PUBLICATIONS

Demon, Ronald, "Black History in America" Internet Archive Wayback Machine, http://www.myblackhistor.net/Ronald_Demon.htm, pp. 1-2 Printed: Sep. 2015.
(Continued)

*Primary Examiner* — Ted Kavanaugh
(74) *Attorney, Agent, or Firm* — Banner & Witcoff, Ltd.

(57) ABSTRACT

A sole structure may include chambers and a transfer channel containing an electrorheological fluid. Electrodes may be positioned to create, in response to a voltage across the electrodes, an electrical field in at least a portion of the electrorheological fluid in the transfer channel. The sole structure may further include a controller including a processor and memory. At least one of the processor and memory may store instructions executable by the processor to perform operations that include maintaining the voltage across the electrodes at one or more flow-inhibiting levels at which flow of the electrorheological fluid the through the transfer channel is blocked, and that further include maintaining the voltage across the electrodes at one or more flow-enabling levels permitting flow of the electrorheological fluid through the transfer channel.

16 Claims, 23 Drawing Sheets

(51) Int. Cl.

| | |
|---|---|
| ***A43B 5/06*** | (2006.01) |
| ***A43B 3/00*** | (2006.01) |
| ***A43B 3/24*** | (2006.01) |
| ***A43B 13/14*** | (2006.01) |
| ***A43B 7/24*** | (2006.01) |

(52) U.S. Cl.
CPC ..... *A43B 5/06* (2013.01); *A43B 7/24* (2013.01); *A43B 13/12* (2013.01); *A43B 13/141* (2013.01); *A43B 13/143* (2013.01); *A43B 13/187* (2013.01); *A43B 13/188* (2013.01)

(58) Field of Classification Search
CPC ..... A43B 5/06; A43B 3/0005; A43B 3/0015; A43B 3/246; A43B 13/12; A43B 13/141
See application file for complete search history.

(56) References Cited

U.S. PATENT DOCUMENTS

| | | | | |
|---|---|---|---|---|
| 4,219,945 | A | 9/1980 | Rudy | |
| 4,471,538 | A | 9/1984 | Pomeranz et al. | |
| 4,898,084 | A | 2/1990 | Oppermann et al. | |
| 4,923,057 | A | 5/1990 | Carlson et al. | |
| 4,952,868 | A | 8/1990 | Scherer, III | |
| 4,999,931 | A | 3/1991 | Vermeulen | |
| 5,222,312 | A * | 6/1993 | Doyle | A43B 13/203 36/28 |
| 5,335,382 | A | 8/1994 | Huang | |
| 5,493,792 | A | 2/1996 | Bates et al. | |
| 5,686,167 | A | 11/1997 | Rudy | |
| 5,771,606 | A * | 6/1998 | Litchfield | A43B 13/203 36/28 |
| 5,794,366 | A | 8/1998 | Chien | |
| 5,813,142 | A | 9/1998 | Demon | |
| 5,896,682 | A | 4/1999 | Lin | |
| 5,979,086 | A | 11/1999 | Vindriis | |
| 6,138,382 | A | 10/2000 | Schoesler | |
| 6,378,558 | B1 | 4/2002 | Pohl et al. | |
| 6,519,873 | B1 | 2/2003 | Buttigieg | |
| 6,812,624 | B1 | 11/2004 | Pei et al. | |
| 6,845,573 | B2 | 1/2005 | Litchfield et al. | |
| 6,889,451 | B2 | 5/2005 | Passke et al. | |
| 6,971,193 | B1 | 12/2005 | Potter et al. | |
| 7,007,412 | B2 * | 3/2006 | Munster | A43B 1/0054 36/132 |
| 7,200,956 | B1 | 4/2007 | Kotha et al. | |
| 7,204,041 | B1 | 4/2007 | Bailey, Sr. et al. | |
| 7,219,449 | B1 | 5/2007 | Hoffberg et al. | |
| 7,254,908 | B2 | 8/2007 | Ungari | |
| 7,409,779 | B2 | 8/2008 | Dojan et al. | |
| 7,950,169 | B2 | 5/2011 | Holt et al. | |
| 8,302,327 | B2 | 11/2012 | Battlogg | |
| 8,324,800 | B2 | 12/2012 | Royster, Jr. et al. | |
| 8,973,613 | B2 | 3/2015 | Murphy et al. | |
| 9,107,475 | B2 | 8/2015 | Ellis | |
| 9,271,538 | B2 | 3/2016 | Ellis | |
| 9,820,531 | B2 | 11/2017 | Walker et al. | |
| 2002/0133237 | A1 | 9/2002 | Christesen | |
| 2003/0056401 | A1 | 3/2003 | Kwon | |
| 2003/0154628 | A1 | 8/2003 | Gyr | |
| 2004/0002665 | A1 | 1/2004 | Parihar et al. | |
| 2004/0154190 | A1 | 8/2004 | Munster | |
| 2004/0177531 | A1 | 9/2004 | DiBenedetto et al. | |
| 2004/0211085 | A1 | 10/2004 | Passke et al. | |
| 2005/0183292 | A1 | 8/2005 | DiBenedetto et al. | |
| 2005/0268487 | A1 | 12/2005 | Ellis | |
| 2006/0143645 | A1 | 6/2006 | Vock et al. | |
| 2006/0248749 | A1 | 11/2006 | Ellis | |
| 2006/0248750 | A1 * | 11/2006 | Rosenberg | A43B 1/0054 36/29 |
| 2007/0000154 | A1 | 1/2007 | DiBenedetto et al. | |
| 2007/0006489 | A1 | 1/2007 | Case et al. | |
| 2008/0245985 | A1 | 10/2008 | Heim et al. | |
| 2009/0200501 | A1 | 8/2009 | Heim et al. | |
| 2009/0235557 | A1 | 9/2009 | Christensen et al. | |
| 2009/0248760 | A1 | 10/2009 | Tone et al. | |
| 2010/0251574 | A1 | 10/2010 | Battlogg et al. | |
| 2012/0273053 | A1 | 11/2012 | Murphy et al. | |
| 2012/0291564 | A1 | 11/2012 | Amos et al. | |
| 2013/0019694 | A1 | 1/2013 | Molyneux et al. | |
| 2013/0185003 | A1 | 7/2013 | Carbeck et al. | |
| 2013/0213147 | A1 | 8/2013 | Rice et al. | |
| 2013/0278436 | A1 | 10/2013 | Ellis | |
| 2014/0033572 | A1 | 2/2014 | Steier et al. | |
| 2014/0053427 | A1 | 2/2014 | Patton | |
| 2014/0068973 | A1 | 3/2014 | Krupenkin et al. | |
| 2014/0250726 | A1 | 9/2014 | Meschter | |
| 2014/0277632 | A1 | 9/2014 | Walker | |
| 2015/0157091 | A1 | 6/2015 | Hsu | |
| 2015/0177081 | A1 | 6/2015 | Steier | |
| 2016/0345663 | A1 * | 12/2016 | Walker | A43B 13/189 |
| 2016/0345669 | A1 | 12/2016 | Orand et al. | |
| 2016/0345670 | A1 | 12/2016 | Orand | |
| 2016/0367192 | A1 | 12/2016 | Iyengar et al. | |
| 2017/0071287 | A1 | 3/2017 | Kim | |
| 2017/0150779 | A1 | 6/2017 | Walker et al. | |
| 2017/0150780 | A1 | 6/2017 | Walker et al. | |
| 2017/0150785 | A1 * | 6/2017 | Walker | B65B 31/02 |
| 2017/0348181 | A1 | 12/2017 | Perriard et al. | |
| 2018/0132566 | A1 * | 5/2018 | Rosenblatt | G05B 15/02 |
| 2019/0059511 | A1 * | 2/2019 | Walker | A43B 13/04 |
| 2019/0059514 | A1 * | 2/2019 | Walker | A43B 13/188 |
| 2019/0110551 | A1 * | 4/2019 | Walker | A43B 7/24 |

FOREIGN PATENT DOCUMENTS

| | | | |
|---|---|---|---|
| JP | 2005279281 | A | 10/2005 |
| JP | 2013215530 | A | 10/2013 |
| KR | 20130048669 | A | 5/2013 |
| WO | 93012685 | A1 | 7/1993 |
| WO | 9835529 | A2 | 8/1998 |
| WO | 0178539 | A2 | 10/2001 |
| WO | 2007125148 | A1 | 11/2007 |
| WO | 2012112931 | A2 | 8/2012 |
| WO | 2014138020 | A1 | 9/2014 |
| WO | 2016191204 | A1 | 12/2016 |

OTHER PUBLICATIONS

Vieroth, et al., Stretchable Circuit Board Technology and Application, Wearable Computers, 2009 ISWC '09, International Symposium. Sep. 7, 2009 (Sep. 7, 2009), pp. 33-36, XP055351553, Piscataway, NJ, USA, DOI: 10.1109/ISWC.2009.13, ISBN: 978-0-7695-3779-5, sentences 3-5, 20-21, paragraph 2.2.
Mar. 15, 2017—(WO) ISR & WO—App. No. PCT/US16/064084.
Nov. 6, 2018—(WO) ISR & WO—App. No. PCT/US18/048719.
Dec. 21, 2018—(EP) Supp. ESR—App. No. 16804005.3.
Mar. 6, 2019—(WO) ISR & WO—App. No. PCT/US18/048729.

* cited by examiner

INCLINE ADJUSTER WITH MULTIPLE DISCRETE CHAMBERS

CROSS REFERENCE TO RELATED APPLICATION

This application claims priority to U.S. provisional patent application No. 62/552,551, titled "INCLINE ADJUSTER WITH MULTIPLE DISCRETE CHAMBERS" and filed Aug. 31, 2017. Application No. 62/552,551, in its entirety, is incorporated by reference herein.

BACKGROUND

Conventional articles of footwear generally include an upper and a sole structure. The upper provides a covering for the foot and securely positions the foot relative to the sole structure. The sole structure is secured to a lower portion of the upper and is configured so as to be positioned between the foot and the ground when a wearer is standing, walking, or running.

Conventional footwear is often designed with the goal of optimizing a shoe for a particular condition or set of conditions. For example, sports such as tennis and basketball require substantial side-to-side movements. Shoes designed for wear while playing such sports often include substantial reinforcement and/or support in regions that experience more force during sideways movements. As another example, running shoes are often designed for forward movement by a wearer in a straight line. Difficulties can arise when a shoe must be worn during changing conditions, or during multiple different types of movements.

SUMMARY

This Summary is provided to introduce a selection of concepts in a simplified form that are further described below in the Detailed Description. This Summary is not intended to identify key features or essential features of the invention.

In at least some embodiments, a sole structure may include a base, an incline adjuster, and a support plate. The base may be located in a forefoot portion of the sole structure, a midfoot portion of the sole structure, and a heel portion of the sole structure. The support plate may be located in at least the forefoot portion of the sole structure. The incline adjuster may include a forefoot section located between the base and the support plate in the forefoot portion of the sole structure and may include at least three chambers. Each of the chambers may contain an electrorheological fluid and be configured to change outward extension in correspondence to change in volume of the electrorheological fluid within the chamber. The chambers may be connected in a series by transfer channels, with each of the transfer channels permitting flow between two of the chambers. The transfer channels may include a flow-regulating transfer channel that includes opposing first and second electrodes extending along an interior of a field-generating portion of the flow-regulating transfer channel.

In some embodiments, an incline adjuster may include a main body and at least three variable-volume chambers extending outward from the main body. Each of the chambers may contain an electrorheological fluid and be configured to change outward extension in correspondence to change in volume of the electrorheological fluid within the chamber. The chambers may be connected in a series by transfer channels, each of the transfer channels permitting flow between two of the chambers. The transfer channels may include a flow-regulating transfer channel. The flow-regulating transfer channel may include opposing first and second electrodes extending along an interior of a field-generating portion of the flow-regulating transfer channel. The field-generating portion may have a length L and an average width W, and a ratio L/W may be at least 50.

In some embodiments, a method of fabricating an incline adjuster may include molding a first component that includes a top side and multiple transfer channel first portions defined in the top side. One of the transfer channel first portions may include an exposed first electrode. The method may include molding a second component that includes a bottom side, a top side, and multiple transfer channel second portions defined in the bottom side. One of the transfer second portions may include an exposed second electrode. Top portions of each of at least three chambers may extend outward from the top side of the second component. The method may further include bonding the top side of the first component to the bottom side of the second component, filling an internal volume with an electrorheological fluid, and sealing the internal volume.

Additional embodiments are described herein.

BRIEF DESCRIPTION OF THE DRAWINGS

Some embodiments are illustrated by way of example, and not by way of limitation, in the figures of the accompanying drawings and in which like reference numerals refer to similar elements.

DETAILED DESCRIPTION

Figure 1:
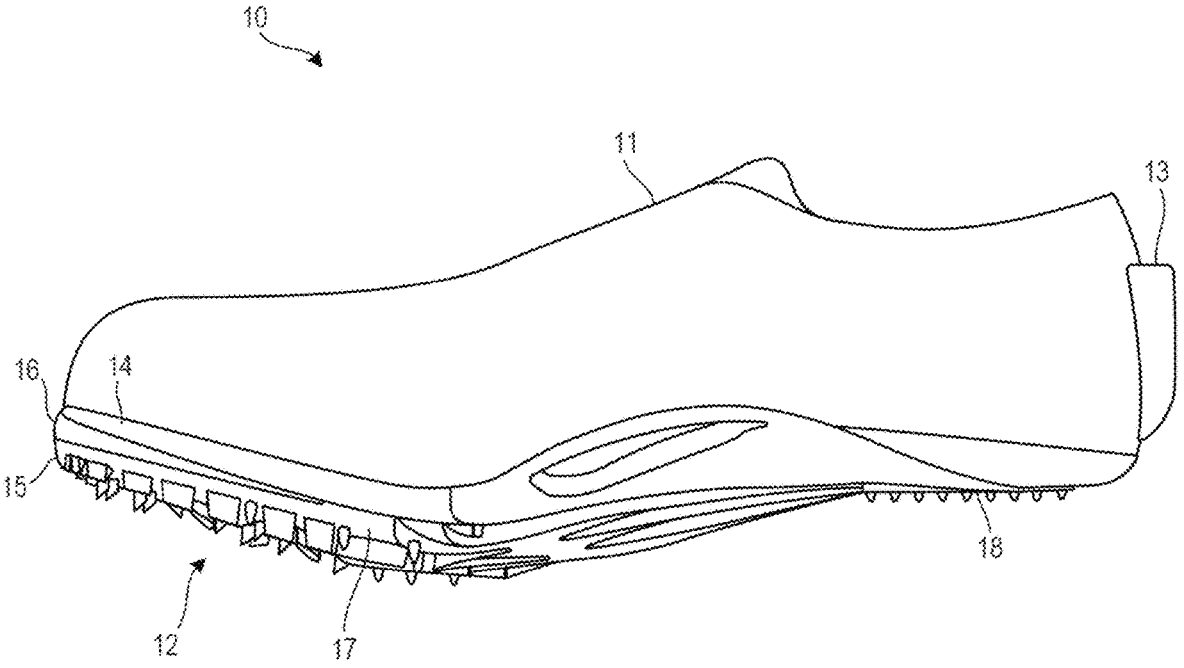
FIG. 1 is a medial side view of a shoe according to some embodiments.

In various types of activities, it may be advantageous to change the shape of a shoe or shoe portion while a wearer of that shoe is running or otherwise participating in the activity. In many running competitions, for example, athletes race around a track having curved portions, also known as "bends." In some cases, particularly shorter events such as 200 meter or 400 meter races, athletes may be running at sprint paces on a track bend. Running on a flat curve at a fast pace is biomechanically inefficient, however, and may require awkward body movements. To counteract such effects, bends of some running tracks are banked. This banking allows more efficient body movement and typically results in faster running times. Tests have shown that similar advantages can be achieved by altering the shape of a shoe. In particular, running on a flat track bend in a shoe having a footbed that is inclined relative to the ground can mimic the benefits of running on a banked bend in a shoe having a non-inclined footbed. However, an inclined footbed is a disadvantage on straight portions of a running track. Footwear that can provide an inclined footbed when running on a bend and reduce or eliminate the incline when running on a straight track section would offer a significant advantage.

In footwear according to some embodiments, electrorheological (ER) fluid is used to change the shape of one or more shoe portions. ER fluids typically comprise a non-conducting oil or other fluid in which very small particles are suspended. In some types of ER fluid, the particles may have diameters of 5 microns or less and may be formed from polystyrene or another polymer having a dipolar molecule. When an electric field is imposed across the ER fluid, the viscosity of the fluid increases as the strength of that field increases. As described in more detail below, this effect can be used to control transfer of fluid and modify the shape of a footwear component. Although track shoe embodiments are initially described, other embodiments include footwear intended for other sports or activities.

"Shoe" and "article of footwear" are used interchangeably herein to refer to an article intended for wear on a human foot. A shoe may or may not enclose the entire foot of a wearer. For example, a shoe could include a sandal-like upper that exposes large portions of a wearing foot. Shoe elements can be described based on regions and/or anatomical structures of a human foot wearing that shoe, and by assuming that the interior of the shoe generally conforms to and is otherwise properly sized for the wearing foot. A forefoot region of a foot includes the heads and bodies of the metatarsals, as well as the phalanges. A forefoot element of a shoe is an element having one or more portions located under, over, to the lateral and/or medial side of, and/or in front of a wearer's forefoot (or portion thereof) when the shoe is worn. A midfoot region of a foot includes the cuboid, navicular, and cuneiforms, as well as the bases of the metatarsals. A midfoot element of a shoe is an element having one or more portions located under, over, and/or to the lateral and/or medial side of a wearer's midfoot (or portion thereof) when the shoe is worn. A heel region of a foot includes the talus and the calcaneus. A heel element of a shoe is an element having one or more portions located under, to the lateral and/or medial side of, and/or behind a wearer's heel (or portion thereof) when the shoe is worn. The forefoot region may overlap with the midfoot region, as may the midfoot and heel regions.

Throughout the following description and in the drawings, similar elements are sometimes identified using a common numerical designator and different appended letters (e.g., lateral chambers 35*a*, 35*b*, and 35*c*). Elements identified in such a manner may also be identified collectively (e.g., lateral chambers 35) or generically (e.g., a lateral chamber 35) using only the numerical designator.

FIG. 1 is a medial side view of a track shoe 10 according to some embodiments. The lateral side of shoe 10 has a similar configuration and appearance, but is configured to correspond to a lateral side of a wearer foot. Shoe 10 is configured for wear on a right foot and is part of a pair that includes a shoe (not shown) that is a mirror image of shoe 10 and is configured for wear on a left foot. As explained in more detail below, however, shoe 10 and its corresponding left shoe may be configured to alter their shapes in different ways under a given set of conditions.

Shoe 10 includes an upper 11 attached to a sole structure 12. Upper 11 may be formed from any of various types or materials and have any of a variety of different constructions. In some embodiments, for example, upper 11 may be knitted as a single unit and may not include a bootie of other type of liner. In some embodiments, upper 11 may be slip lasted by stitching bottom edges of upper 11 to enclose a foot-receiving interior space. In other embodiments, upper 11 may be lasted with a strobel or in some other manner. A battery assembly 13 is located in a rear heel region of upper 11 and includes a battery that provides electrical power to a controller. The controller is not visible in FIG. 1, but is described below in connection with other drawing figures.

Sole structure 12 includes a footbed 14, an outsole 15, and an incline adjuster 16. Incline adjuster 16 is situated between outsole 15 and footbed 14. As explained in more detail below, incline adjuster 16 includes medial side fluid chambers that support a medial forefoot portion of footbed 14, as well as lateral side fluid chambers that support a lateral forefoot portion of footbed 14. ER fluid may be transferred between chambers through transfer channels that are in fluid communication with the interiors of the chambers. That fluid transfer may raise the heights of chambers on one side relative to the heights of chambers on the other side, resulting in an incline in a portion of footbed 14 located over the chambers. When further flow of ER fluid through the one of the channels is interrupted, the incline is maintained until ER fluid flow is allowed to resume.

Figure 2A:
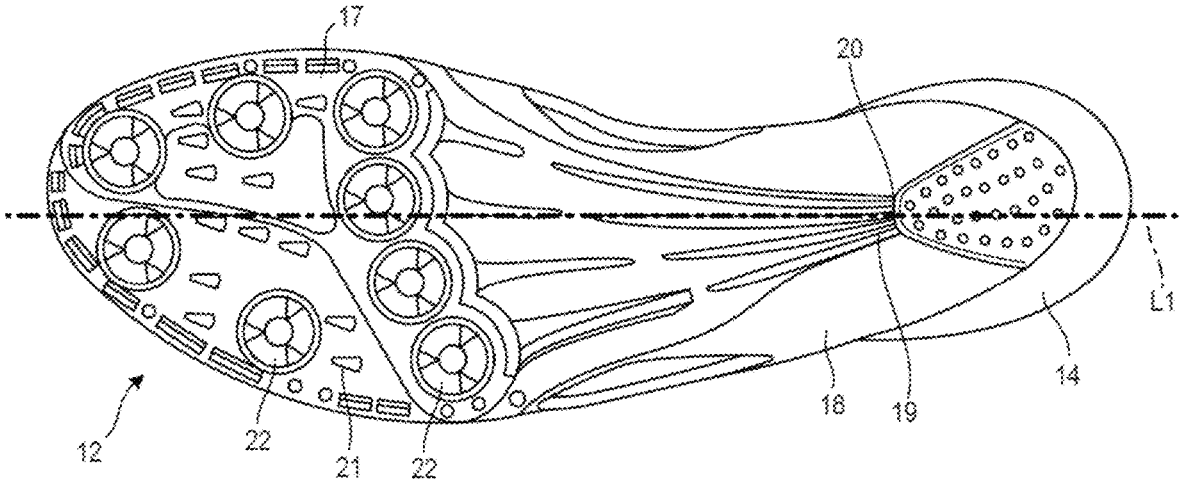
FIG. 2A is a bottom view of the sole structure of the shoe of FIG. 1.
Figure 2B:
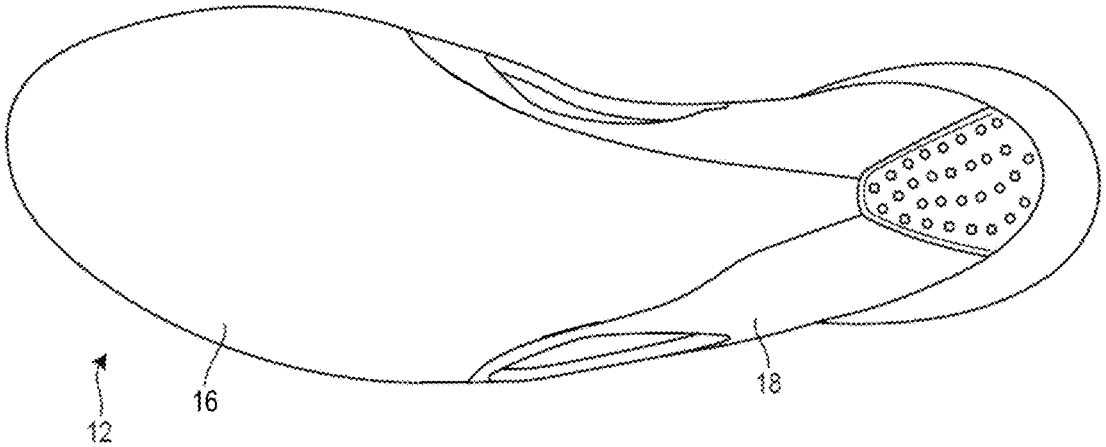
FIG. 2B is a bottom view of the sole structure of the shoe of FIG. 1, but with a forefoot outsole element removed.
Figure 2C:
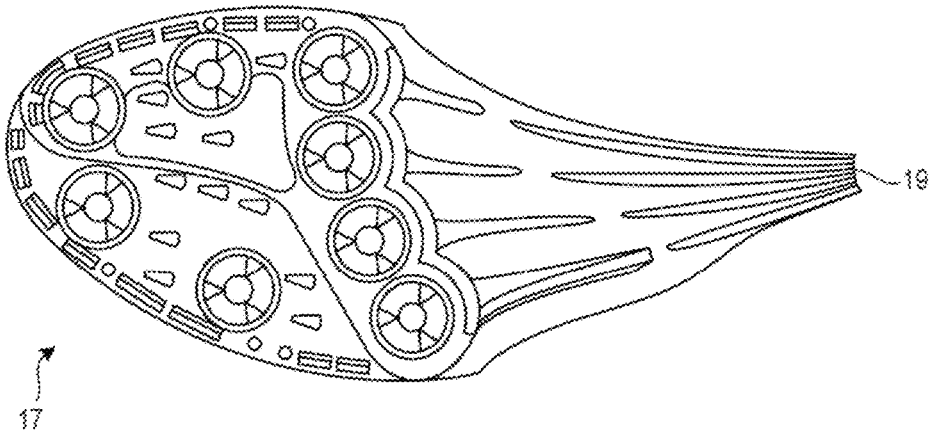
FIG. 2C is a bottom view of the forefoot outsole element of the sole structure of the shoe of FIG. 1.

Outsole 15 forms the ground-contacting portion of sole structure 12. In the embodiment of shoe 10, outsole 15 includes a forward outsole section 17 and a rear outsole section 18. The relationship of forward outsole section 17 and rear outsole section 18 can be seen by comparing FIG. 2A, a bottom view of sole structure 12, and FIG. 2B, a bottom view of sole structure 12 with forefoot outsole section 17 removed. FIG. 2C is a bottom view of forefoot outsole section 17 removed from sole structure 12. As seen in FIG. 2A, forward outsole section 17 extends through forefoot and central midfoot regions of sole structure 12 and tapers to a narrowed end 19. End 19 is attached to rear outsole section 18 at a joint 20 located in the heel region. Rear outsole section 18 extends over side midfoot regions. Forefoot outsole section 17 pivots about a longitudinal axis L1 passing through joint 20. In particular, and as explained below, forefoot outsole section 17 rotates about axis L1 as a forefoot portion of footbed 14 inclines relative to forefoot outsole section 17.

Outsole 15 may be formed of a polymer or polymer composite and may include rubber and/or other abrasion-resistant material on ground-contacting surfaces. Traction elements 21 may be molded into or otherwise formed in the bottom of outsole 15. Forefoot outsole section 17 may also include receptacles to hold one or more removable spike elements 22. In other embodiments, outsole 15 may have a different configuration.

Footbed 14 includes a midsole 25. In the embodiment of shoe 10, midsole 25 has a size and a shape approximately corresponding to a human foot outline, is a single piece that extends the full length and width of footbed 14, and includes a contoured top surface 26 (shown in FIG. 3). The contour of top surface 26 is configured to generally correspond to the shape of the plantar region of a human foot and to provide arch support. Midsole 25 may be formed from ethylene vinyl acetate (EVA) and/or one or more other closed cell polymer foam materials. Upwardly extending medial and lateral sides of rear outsole section 18 may also provide additional medial and lateral side support to a wearer foot. In other embodiments, a footbed may have a different configuration, e.g., a midsole may cover less than all of a footbed or may be entirely absent, and/or a footbed may include other components.

Figure 3:
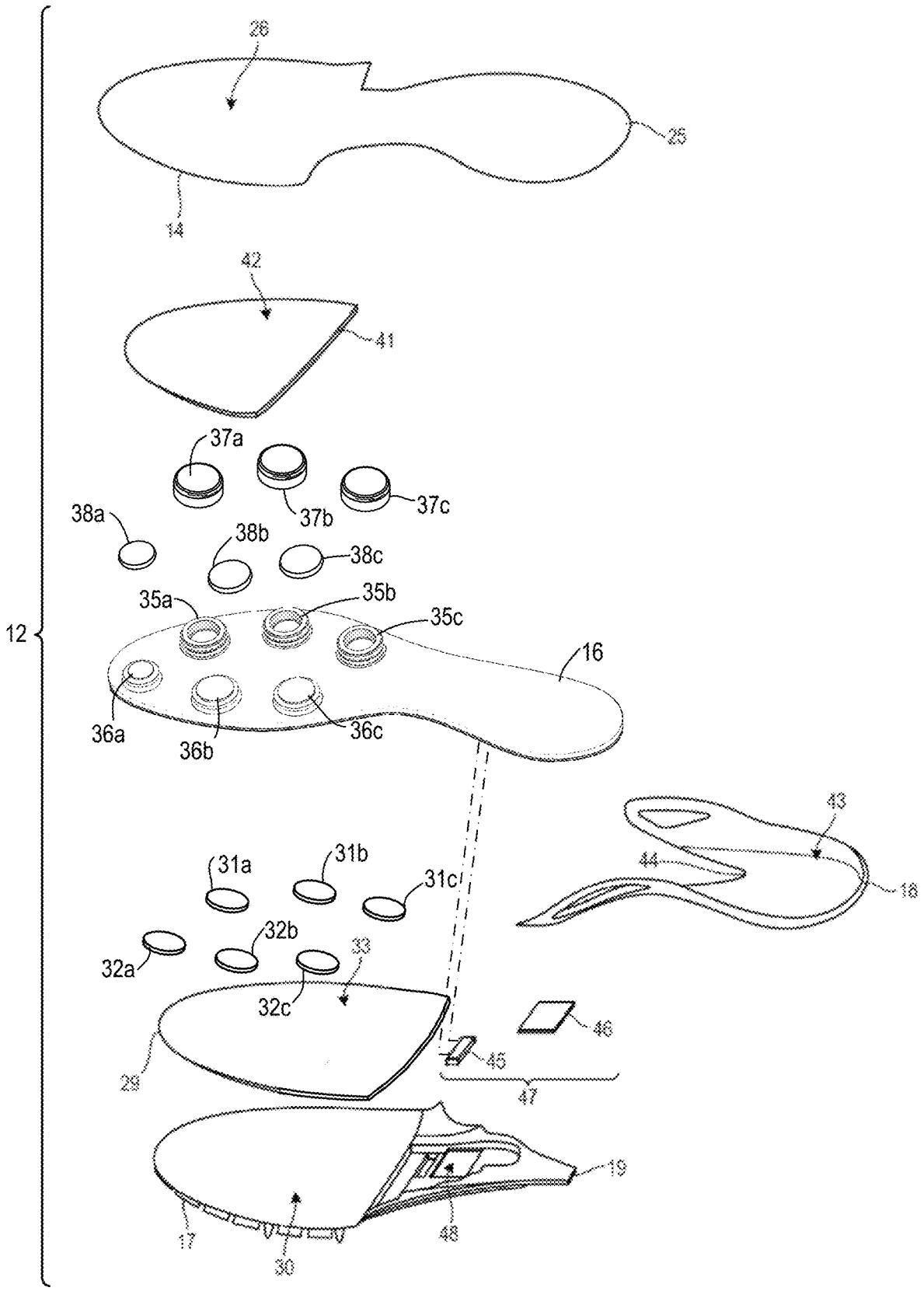
FIG. 3 is a partially exploded medial perspective view of the sole structure of the shoe of FIG. 1.

FIG. 3 is a partially exploded medial perspective view of sole structure 12. Bottom support plate 29 is located in a plantar region of shoe 10. In the embodiment of shoe 10, bottom support plate 29 is attached to a top surface 30 of forward outsole section 17. Bottom support plate 29, which may be formed from a relatively stiff polymer or polymer composite, helps to stiffen the forefoot region of forward outsole section 17 and provide a stable base for incline adjuster 16. A front forefoot force sensing resistor (FSR) 32*a*, an intermediate forefoot FSR 32*b*, and a rear forefoot FSR 32*c* are attached to a top surface 33 of bottom support plate 29 on a medial side of a forefoot region. Similarly, a front forefoot FSR 31*a*, an intermediate forefoot FSR 31*b*, and a rear forefoot FSR 31*c* are attached to top surface 33 on a lateral side of a forefoot region. As explained below, FSRs 31 and 32 provide outputs that help determine pressures within chambers of incline adjuster 16.

Incline adjuster 16 is attached to top surface 33 of lower support plate 29 and to a top surface 43 of rear outsole section 18. Lateral chambers 35*a*, 35*b*, and 35*c* of incline adjuster 16 are respectively positioned over lateral FSRs 31*a*, 31*b*, and 31*c*. Medial chambers 36*a*, 36*b*, and 36*c* of incline adjuster 16 are respectively positioned over medial FSRs 32*a*, 32*b*, and 32*c*. Chamber caps 37*a*, 37*b*, and 37*c* are positioned over chambers 35*a*, 35*b*, and 35*c*, respectively. Chamber caps 38*a*, 38*b*, and 38*c* are positioned over chambers 36*a*, 36*b*, and 36*c*, respectively. As explained in more detail in connection with FIG. 10, chamber caps 37 and 38 provide an interface between chambers 35 and 36 and the underside of a top support plate 41. Top support plate 41 is located in a plantar region of shoe 10 and is positioned over incline adjuster 16. In the embodiment of shoe 10, top support plate 41 is generally aligned with bottom support plate 29. Top support plate 41, which may also be formed from a relatively stiff polymer or polymer composite, provides a stable and relatively non-deformable region against which incline adjuster 16 may push, and which supports the forefoot region of footbed 14.

A forefoot region portion of the midsole 25 underside is attached to the top surface 42 of top support plate 41. Portions of the midsole 25 underside in the heel and midfoot regions are attached to a top surface incline adjuster 16 in heel and midfoot regions thereof. End 19 of forward outsole section 17 is attached to rear outsole section 18 behind the rear-most location 44 of the front edge of section 18 so as to form joint 20. In some embodiments, end 19 may be a tab that slides into a slot formed in section 18 at or near location 14, and/or may be wedged between top surface 43 and the underside of incline adjuster 16.

Also shown in FIG. 3 are a DC-to-high-voltage-DC converter 45 and a printed circuit board (PCB) 46 of a controller 47. Converter 45 converts a low voltage DC electrical signal into a high voltage (e.g., 5000V) DC signal that is applied to electrodes within incline adjuster 16. PCB 46 includes one or more processors, memory and other components and is configured to control incline adjuster 16 through converter 45. PCB 46 also receives inputs from FSRs 31 and 32 and receives electrical power from battery unit 13. PCB 46 and converter 45 may be attached to the top surface of forward outsole section 17 in a midfoot region 48.

Figure 4A:
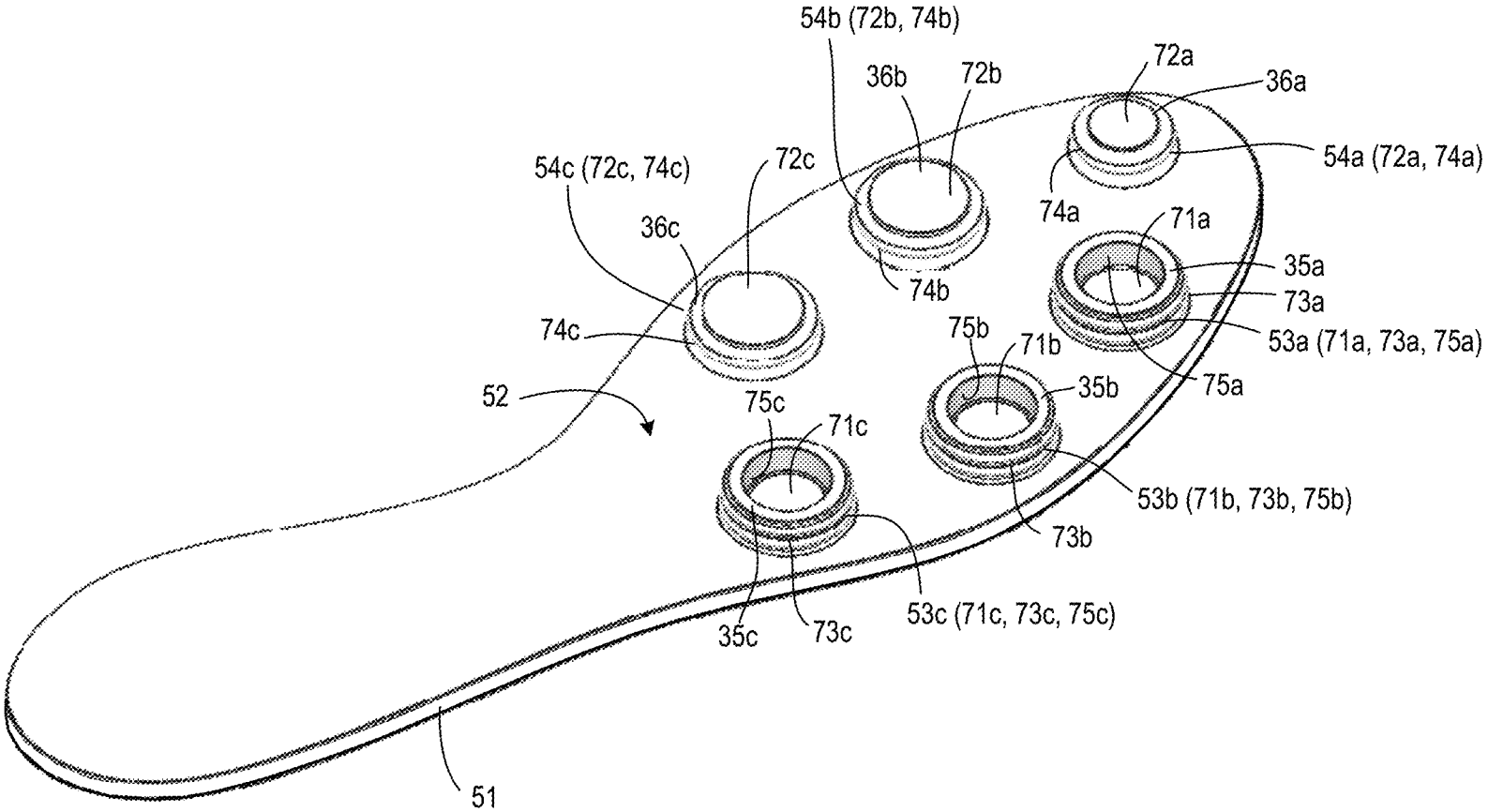
FIG. 4A is an enlarged rear lateral top perspective view of an incline adjuster of the shoe of FIG. 1.
Figure 4B:
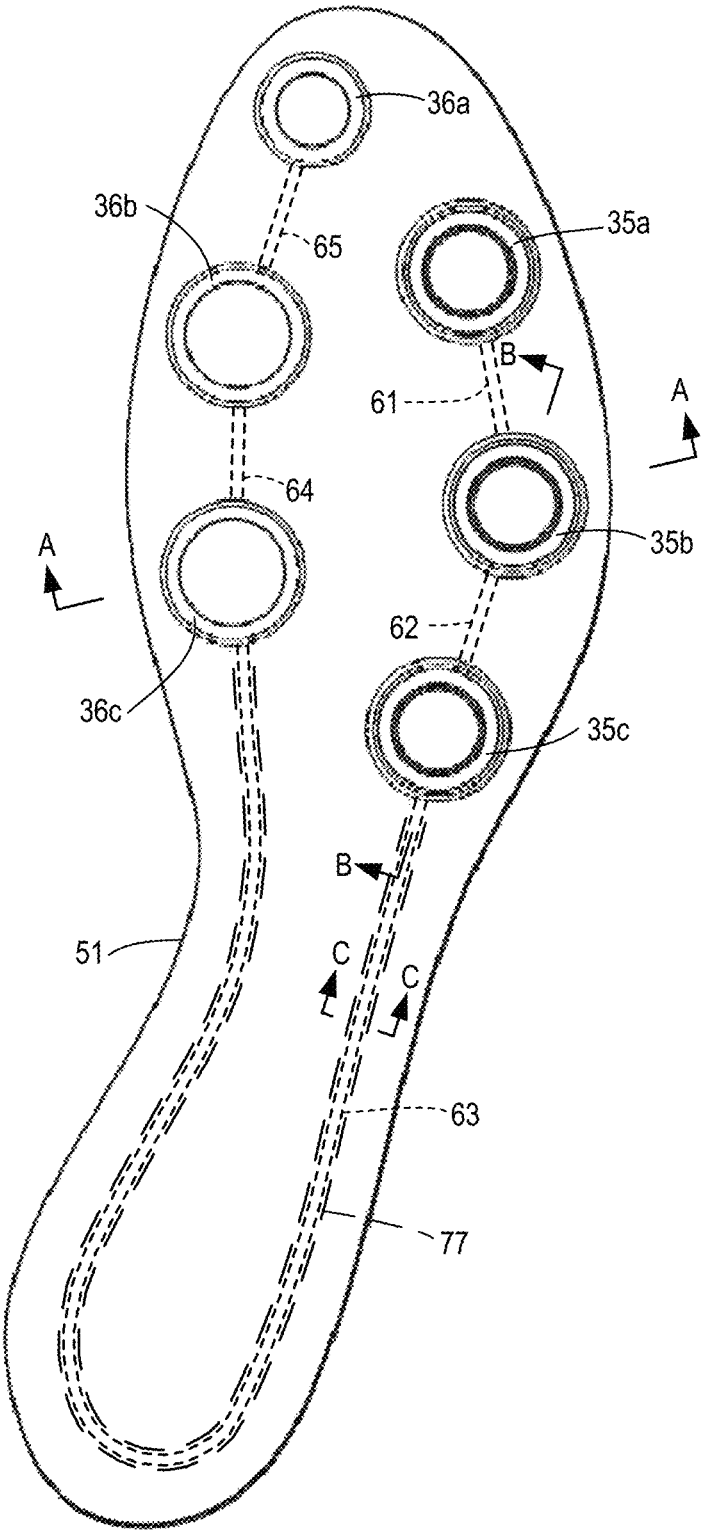
FIG. 4B is a top view of the incline adjuster of FIG. 4A.
Figure 4C:
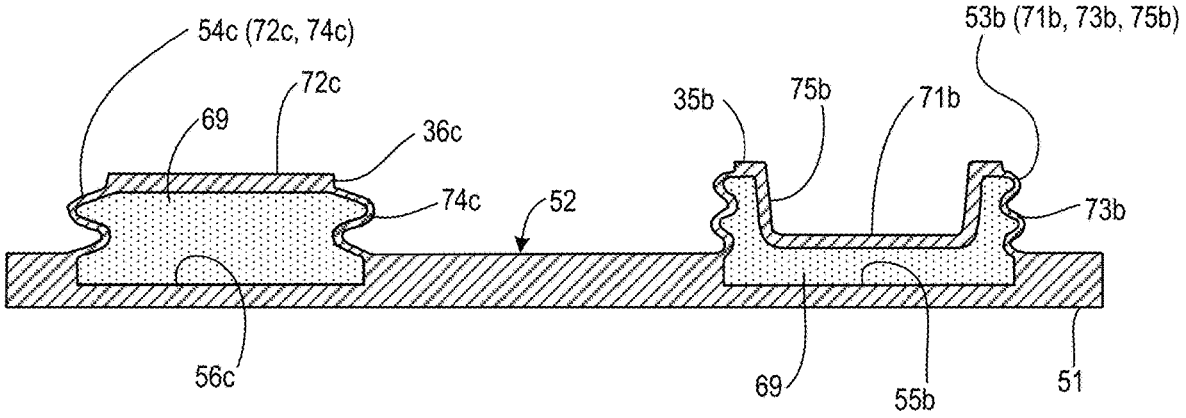
FIG. 4C is an area cross-sectional view taken from the plane indicated in FIG. 4B by arrows A-A.
Figure 4D:
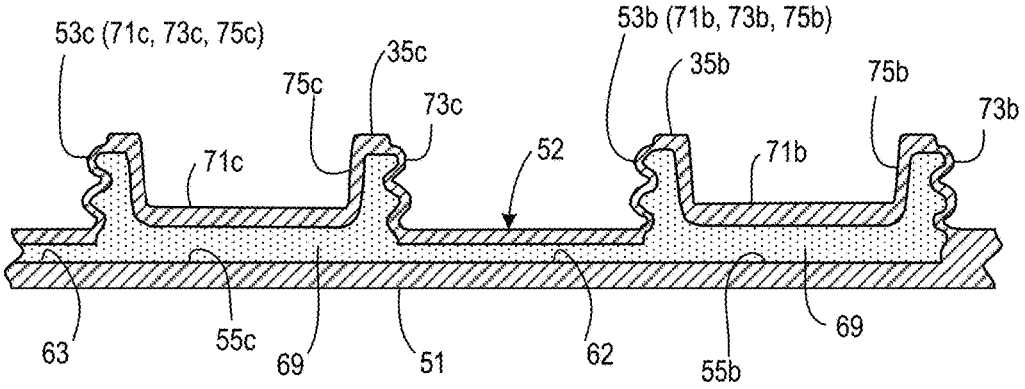
FIG. 4D is an area cross-sectional view taken from the plane indicated in FIG. 4B by arrows B-B.

FIG. 4A is an enlarged rear lateral top perspective view of incline adjuster 16. FIG. 4B is an enlarged top view of incline adjuster 16. FIG. 4C is an area cross-sectional view taken from the plane indicated in FIG. 4B by arrows A-A. FIG. 4D is an area cross-sectional view taken from the plane indicated in FIG. 4B by arrows B-B.

Incline adjuster 16 includes a main body 51. A portion of lateral chamber 35*b* is bounded by a flexible contoured wall 53*b* that extends upward from a lateral side of the top 51 of main body 51. Contoured wall 53*b* includes an outer side section 73*b* and an inner side section 75*b*, as well as a central section 71*b*. Another portion of lateral chamber 35*b* is bounded by a corresponding region 55*b* in main body 65 (FIGS. 4C and 4D). Lateral chambers 35*a* and 35*c* each has a structure similar to that of chamber 35*b* and that includes respective flexible contoured walls 53*a* and 53*c* that extend upward from a lateral side of the top 52 of main body 51, as well as respective portions bounded by corresponding regions in main body 51 similar to region 55*b*. Each of walls 53*a* and 53*c* includes respective outer side sections 73*a* and 73C, respective inner side sections 75*a* and 75*c*, and respective central sections 71*a* and 71*c*.

A portion of medial chamber 36*c* is bounded by a flexible contoured wall 54*c* that extends upward from a medial side of top side 52. Contoured wall 54*c* includes a side section 74*c* and a central section 72*c*. Another portion of medial chamber 36*c* is bounded by a corresponding region 56*c* in main body 51. Medial chambers 36*a* and 36*b* each has a structure similar to that of chamber 36*c* and that includes respective flexible contoured walls 54*a* and 54*b* that extend upward from a medial side of the top 52 of main body 51, as well as respective portions bounded by corresponding regions in main body 51 similar to region 56*c*. Each of walls 54*a* and 54*b* includes respective side sections 74*a* and 74*b* and respective central sections 72*a* and 72*b*.

In the embodiment of FIGS. 4A through 4D, chambers 35 and 36 are located at positions that correspond to higher impact forces during different parts of a gait cycle when running around track bends. Chamber 36*a* is in a position that, in a completed shoe 10, generally corresponds to a wearer's hallux (big toe). Chamber 36*b* is in a position that corresponds to a wearer's first metatarsal head (ball of the foot). Chamber 36*c* is in a position that corresponds to a wearer's first metatarsal base. Chamber 35*a* is in a position that corresponds to a wearer's fifth distal phalange (little toe). Chamber 35*b* is in a position that corresponds to a wearer's fifth metatarsal head. Chamber 35*c* is in a position that corresponds to a wearer's fifth metatarsal base.

In some embodiments, chambers are round in a plane of a main body from which the chambers extend and have diameters between 15 millimeters and 30 millimeters. In some embodiments, chamber 36*a* has a diameter of 20 millimeters and each of chambers 36*b*, 36*c*, and 35*a* through 35*c* has a diameter of 25 millimeters. Minimizing chamber size minimizes chamber deformation when footwear 10 impacts the ground during actual use, thereby potentially minimizing noise in the control system.

As can be appreciated from FIG. 4B, chambers 35*a*, 35*b*, 35*c*, 36*c*, 36*b*, and 36*a* of incline adjuster 16 are connected in series by transfer channels, with each of the transfer channels connecting a different pair of chambers. Lateral chamber 35*a* is in fluid communication with lateral chamber 35*b* through a transfer channel 61 defined in a portion of main body 51 and extending between chambers 35*a* and 35*b*. Incline adjuster 16 is opaque in the embodiment of FIGS. 4A-4D, and the location of transfer channel 61 and of other transfer channels is therefore indicated in FIG. 4B with small broken lines. Lateral chamber 35*b* is in fluid communication with lateral chamber 35*c* through a transfer channel 62 defined in a portion of main body 51 and extending between chambers 35*b* and 35*c*. Medial chamber 36*a* is in fluid communication with medial chamber 36*b* through a transfer channel 65 defined in a portion of main body 51 and extending between chambers 36*a* and 36*b*. Medial chamber 36*b* is in fluid communication with medial chamber 36*c* through a transfer channel 64 defined in a portion of main body 51 and extending between chambers 36*b* and 36*c*. Medial chamber 36*c* is in fluid communication with lateral chamber 35*c* through a transfer channel 63 that extends rearward from chamber 36*c* to a heel region of main body 31, and which then returns forward to lateral chamber 35*c*.

As can be seen in FIG. 4B, a transfer channel does not extend directly between chambers 36*c* and 35*b*. Accordingly, no transfer channel portions are visible in FIG. 4C. However, transfer channel 62 and a portion of transfer channel 63 can be seen in FIG. 4D. The remainder of transfer channel 63, as well as transfer channels 61, 64, and 65, have chamber connections and vertical locations with main body 51 similar to those shown in FIG. 4D. Moreover, the width and height of all transfer channels is generally constant in at least some embodiments.

An ER fluid 69 fills chambers 35, chambers 36, and transfer channels 61 through 65. One example of an ER fluid that may be used in some embodiments is sold under the name "RheOil 4.0" by ERF Produktion Würzberg GmbH. The internal volumes of lateral chambers 35 may vary as ER fluid 69 flows into or out of lateral chambers 35. The portion of each chamber 35 formed by a wall 53 is configured to expand when ER fluid 69 flows into that chamber 35, thereby displacing a central section 71 of that wall 53 upward from main body 51. The internal volumes of medial chambers 36 may similarly vary as ER fluid 69 flows into or out of medial chambers 36. The portion of each chamber 36 formed by a wall 54 is configured to expand when ER fluid 69 flows into that chamber 36, thereby displacing a central section 72 of that wall 54 upward from main body 51.

A pair of opposing electrodes is positioned within transfer channel 63 on bottom and top sides and extends along a field-generating portion 77 of transfer channel 63, indicated in FIG. 4B with large broken lines. Separate leads are in respective electrical contact with the bottom and top electrodes and are connected to converter 45. Transfer channel 63 has an elongated shape so as to provide increased surface area for electrodes within channel 63 to create an electrical field in ER fluid 69 within channel 63. In some embodiments, transfer channel 63 may have a maximum height h between electrodes of 1 millimeter (mm), an average width (w) of 2 mm, and a length along the flow direction between chambers 35*c* and 36*c* of at least 250 mm. In some embodiments, transfer channel 63 may have a maximum height h between electrodes of 1 millimeter (mm), an average width (w) of 4 mm, and a length along the flow direction between chambers 35*c* and 36*c* of at least 250 mm. In some embodiments, the length of transfer channel 63 may exceed 270 mm.

In some embodiments, height of the transfer channel may practically be limited to a range of at least 0.250 mm to not more than 3.3 mm. An incline adjuster constructed of pliable material may be able to bend with the shoe during use. Bending across the transfer channel locally decreases the height at the point of bending. If sufficient allowance is not made, the corresponding increase in electric field strength may exceed the maximum dielectric strength of the ER fluid, causing the electric field to collapse. In the extreme, electrodes could become so close that they actually touch, with a resultant electric field collapse.

The viscosity of ER fluid increases with the applied electric field strength. The effect is non-linear and the optimum field strength is in the range of 3 to 6 kilovolts per millimeter (kV/mm). The high-voltage dc-dc converter used to boost the 3 to 5 V of the battery may be limited by physical size and safety considerations to less than 2 W or a maximum output voltage of less than or equal to 10 kV. To keep the electric field strength within the desired range, the height of the transfer channel may therefore be limited in some embodiments to a maximum of about 3.3 mm (10 kV/3 kV/mm).

The width of a transfer channel may be practically limited to a range of at least 0.5 mm to not more than 4 mm. The maximum width of a channel may be limited by the physical space between chambers. The equivalent series resistance of ER fluid will also decrease as channel width increases, which increases the power consumption. For a shoe size range down to M7 (US) the practical width may be limited to less than 4 mm.

The opposing electrodes in field-generating portion 77 of transfer channel 63 may be energized to increase the viscosity of ER fluid 69 in field-generating portion 77, thereby slowing or stopping flow of ER fluid 69 through channel 63. When flow through transfer channel 63 is enabled, downward force on central sections 72 of medial chambers 36 forces ER fluid 69 out of chambers 36 and through transfer channel 63 into chambers 35. As ER fluid 69 is transferred out of chambers 36 and into chambers 35, central sections 72 move downward toward main body 51 and central sections 71 move upward away from main body 51. Conversely, downward force on central sections 71 (when flow through transfer channel 63 is enabled) forces ER fluid 69 out of chambers 35, through transfer channel 63, and into chambers 36. As ER fluid 69 is transferred out of chambers 35 and into chambers 36, central sections 71 move downward toward main body 51 and central sections 72 move upward away from main body 51. As discussed in more detail below in connection with FIGS. 12A-12C, change in the relative heights of central sections 71 and central sections 72 changes an inclination angle of top support plate 41 relative to bottom support plate 29.

The desired length of the transfer channel may be a function of the maximum pressure difference between chambers of the incline adjuster when in use. The longer the channel, the greater the pressure difference that can be withstood. Optimum channel length may be application dependent and construction dependent and therefore may vary among different embodiments. A detriment of a long channel is a greater restriction to fluid flow when the electric field is removed. In some embodiments, practical limits of channel length are in the range of 25 mm to 350 mm. In at least some embodiments, field-generating portion 77 may have an L/w ratio of at least 50, where L is the length of field-generating portion 77, and wherein w is the average width of field-generating portion 77. Exemplary minimum values for the L/w ratio of a transfer channel field-generating portion in other embodiments include 60, 70, 80, 90, 100, 110, 120, 130, 140, 150, 160, and 170. In some embodiments, the minimum area of each opposing electrode that contacts ER fluid in a field-generating transfer channel portion may be, for transfer channels with an average channel width of 4 mm, 800 square millimeters. As explained in more detail below, mounting features of electrodes may be encapsulated within the wall of the channel and thus may not contact the ER fluid. The total area of the electrode may therefore be greater than the exposed functional area.

As seen in FIGS. 4C and 4D, outer side sections 73*b* and 73*c* extend upward from top side 52 and join an inner side sections 75*b* and 75*c*, with inner side sections 75*b* and 75*c* joined to central sections 71*b* and 71*c*. Sections 73*a*, 75*a*, and 71*a* of chamber 35*a* have a similar structure. Sections 75 and 71 form depressions in the exterior shapes of lateral chambers 35. These depressions allow reduction in the total volume of ER fluid 69 needed within the system. In the embodiment of FIGS. 4A-4D, only lateral chambers 35 include an external depression. In other embodiments, any, all, or no chambers may include depressions (e.g., some, none of, or all lateral chambers and/or some, none of, or all medial chambers may include an external depression).

In some embodiments, incline adjuster chambers may have bellows shapes. For example, and as seen in FIG. 4C, outer side section 73*b* has folds that define a bellows shape of lateral chamber 35*b*. Side section 74*c* of wall 54*c* also has folds that define a bellows shape of medial chamber 36*c*. In the embodiment of FIGS. 4A-4D, the outer sides of the lateral chambers have more folds than the sides of the medial chambers. In some embodiments, chambers on both sides may the same number of folds, while in still other embodiments a medial chamber may have more folds than a lateral chamber. Bellows shapes of chambers facilitate increased flexure during expansion and contraction of chambers. This helps to minimize wear, as well as to decrease the total amount of ER fluid needed within the system. In some embodiments, some or all chambers may not have a bellows shape.

In some embodiments, incline adjuster 16 may be fabricated by separately forming bottom and top components. The bottom component may include regions 55 of chambers 35 and regions 56 of chambers 36, bottom portions of transfer channels 61 through 65, and a bottom electrode. The top component may include walls 53 of chambers 35 and walls 54 of chambers 36, top portions of transfer channels 61 through 65, and a top electrode. Once formed, a top side of the bottom component may be bonded to the bottom side of the top component. An internal volume comprising internal volumes of chambers 35, chambers 36, and transfer channels 60 through 65 may then be filled with ER fluid 69, and the internal volume sealed.

Figure 5A:
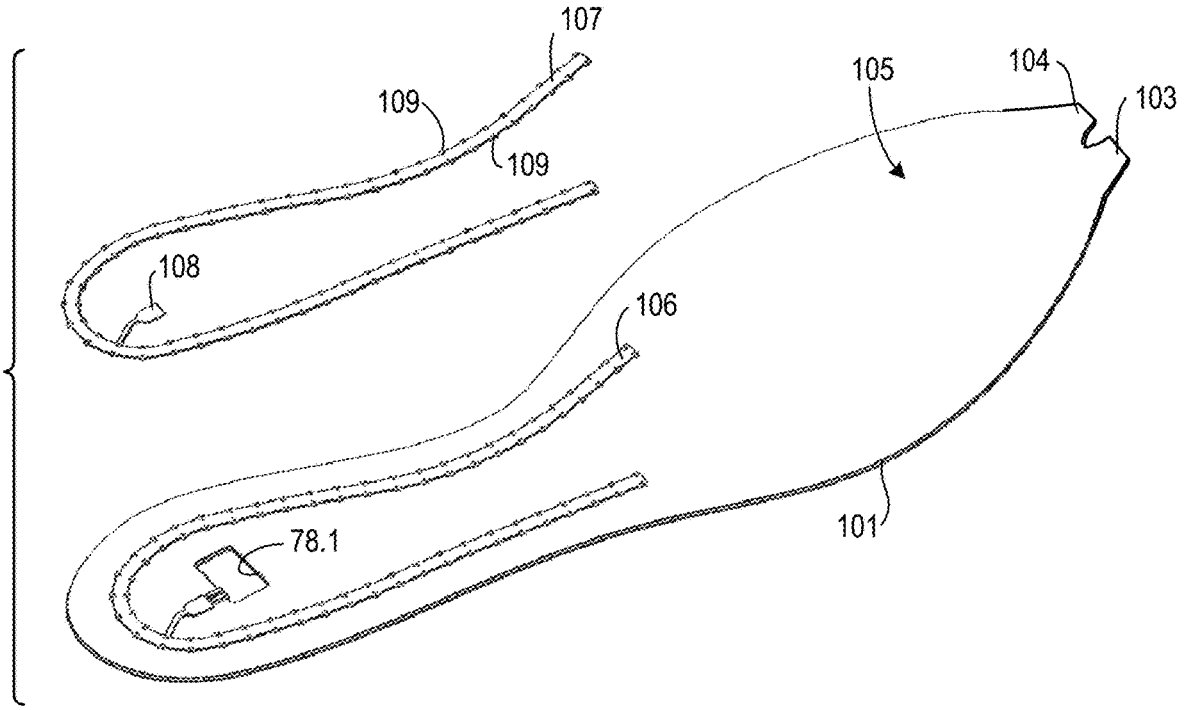
FIG. 5A shows a first layer of a first component of the incline adjuster of FIG. 4A, together with a metal first electrode.
Figure 5B:
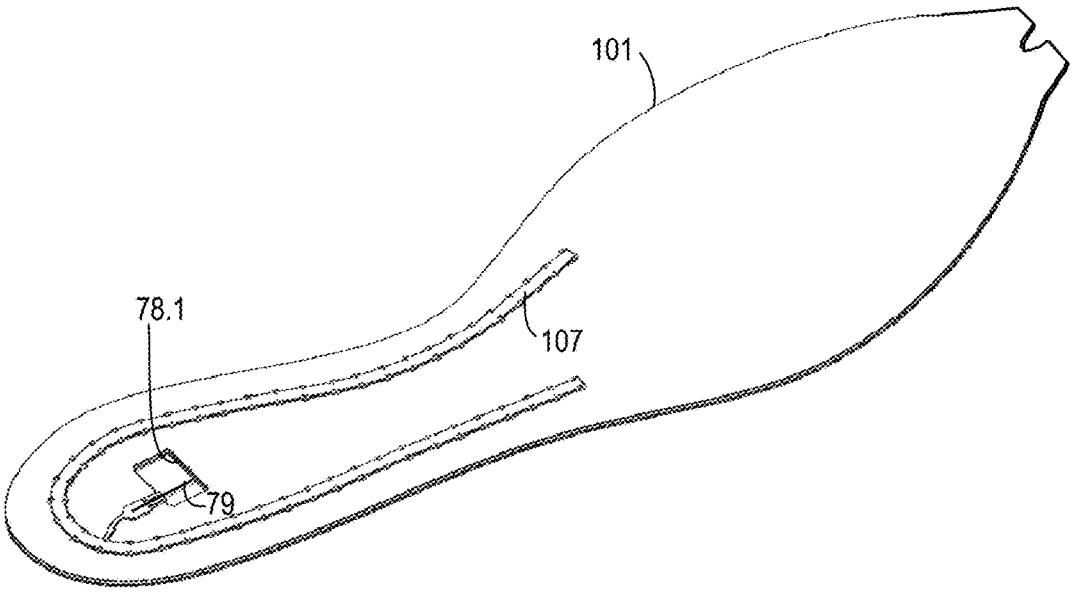
FIG. 5B shows the first layer of FIG. 5A after attachment of the first electrode of FIG. 5A.
Figure 5C:
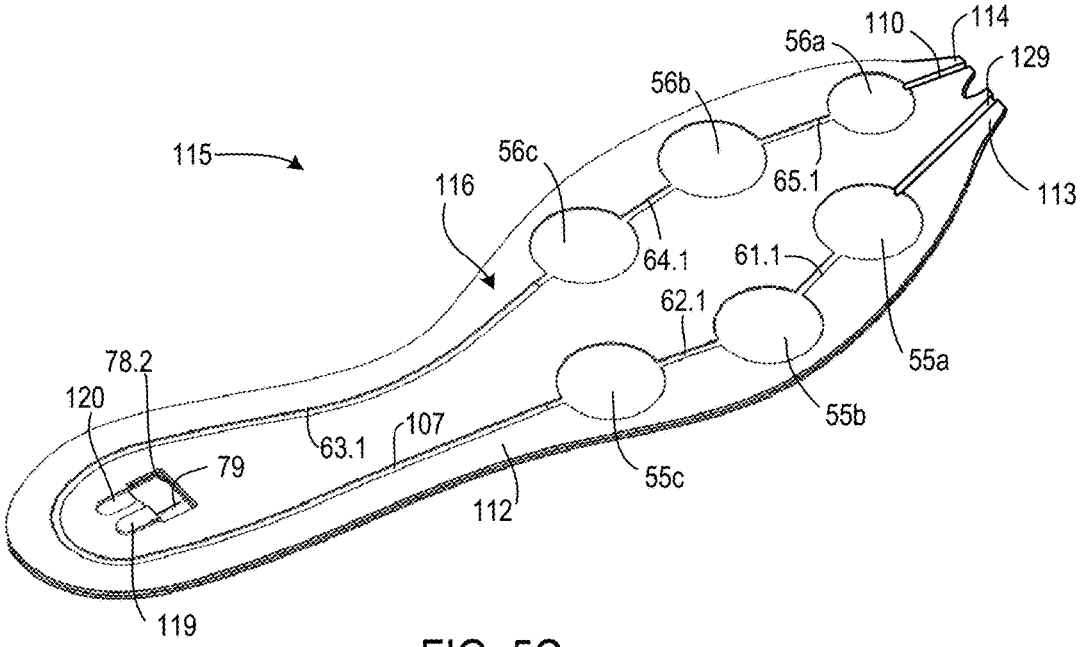
FIG. 5C shows the first component of the incline adjuster of FIG. 4A after molding of a second layer over the first layer and attached first electrode.

FIGS. 5A through 5C illustrate steps in forming the bottom component of incline adjuster 16. First, and as shown in FIG. 5A, a first layer 101 is injection molded. Layer 101 will form the bottom layer of the bottom component. The perimeter of layer 101 has a shape that, except for front extensions 103 and 104, is the same as the shape of the perimeter of main body 51. Extensions 103 and 104 will form portions of necks that will have sprues through which incline adjuster 16 may be filled with ER fluid 69. After filling, those sprues may be sealed and the necks removed. Except for an opening 78.1 which will form part of a cavity exposing electrical leads, layer 101 is continuous. The top surface 105 of layer 101 includes a raised portion 106. Raised portion 106 has a shape that corresponds to, and that defines a seat for, a bottom electrode 107.

Bottom electrode 107, also shown in FIG. 5A, is a continuous metal sheet. In some embodiments, bottom electrode 107 may be formed from 0.05 mm thick, 1010 nickel plated, cooled rolled steel. Electrode 107 includes a pad 108 for attachment of an electrical lead 79 (FIG. 5B). Edges of electrode 107 also include a series of slots 109 formed along both edges. Exemplary dimensions for slots 109 are 0.5 mm×1 mm. As described in more detail below, material may flow into slots 109 during molding of the bottom component so as to secure electrode 107 in position.

In FIG. 5B, electrode 107 is attached to raised portion 106. In some embodiments, a pressure-sensitive adhesive (PSA) may be applied to a bottom surface of electrode 107 and/or to a top surface of raised portion 106 to hold electrode 107 in place during a subsequent molding operation (described below). A lead 79 may be put in place and attached to pad 108 by soldering, by using conductive epoxy, or by other technique.

After attachment of electrode 107 and lead 79, a second layer 112 is overmolded onto layer 101. The resulting bottom component 115 of incline adjuster 16 is shown in FIG. 5C. Regions 55 of chambers 35 and regions 56 of chambers 36 are defined in a top surface 116 of bottom component 115. Bottom portions 61.1, 62.1, 63.1, 64.1, and 65.1 of transfer channels 61, 62, 63, 64, and 65, respectively, are similarly formed in top surface 116. A portion of electrode 107 is exposed in bottom portion 63.1. Opening 78.2 in layer 112, which aligns with opening 78.1 in layer 101, will form additional portions of a cavity containing electrical lead 79 and a similar electrical lead for a top electrode (described below). Layer 112 also includes extensions 113 and 114 that overlay extensions 103 and 104 of layer 101. A channel 129 in extension 113 will form a portion of a lateral side sprue. A channel 110 in extension 114 will form a portion of a medial side sprue. A raised region 119, which extends from top surface 116 over lead 53, will fit into a depression in the bottom surface of the top component of incline adjuster 16. A depression 120 is formed in top surface 116 to accept a corresponding raised region, in the bottom surface of the top component, corresponding to a lead described below.

In some embodiments, layer 101 may be injection molded from thermoplastic polyurethane (TPU). Layer 112 may be injection overmolded onto layer 101 (with attached electrode 107 and lead 79). Layer 112 may be formed from the same type of TPU used to form layer 101.

Figure 6A:
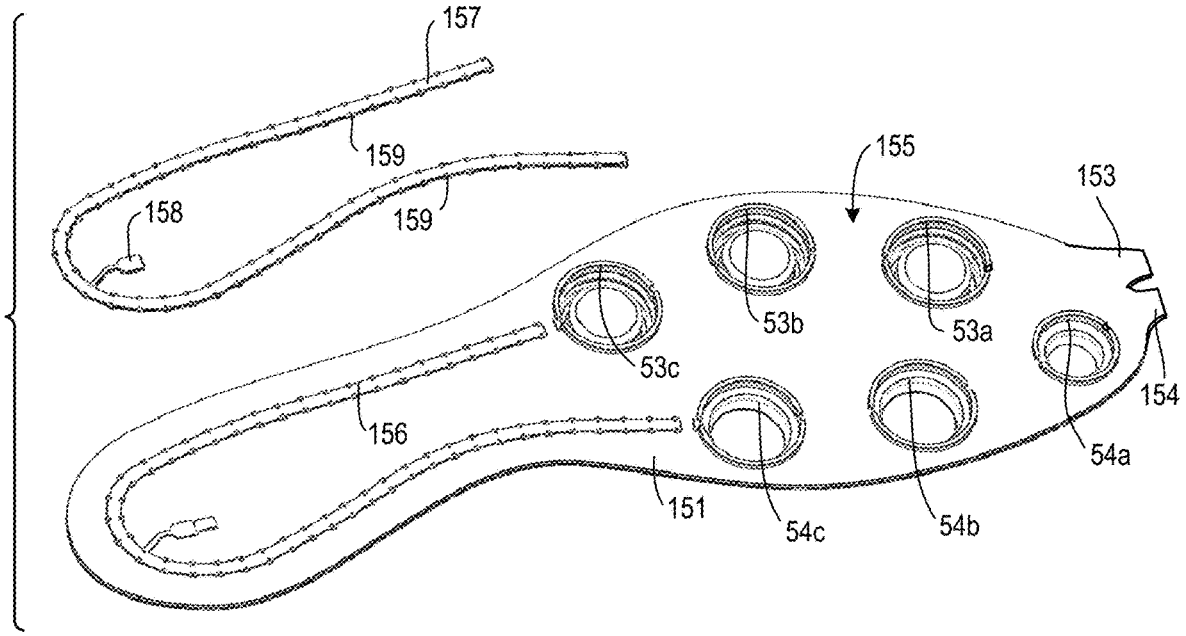
FIG. 6A shows a first layer of a second component of the incline adjuster of FIG. 4A, together with a metal second electrode.
Figure 6B:
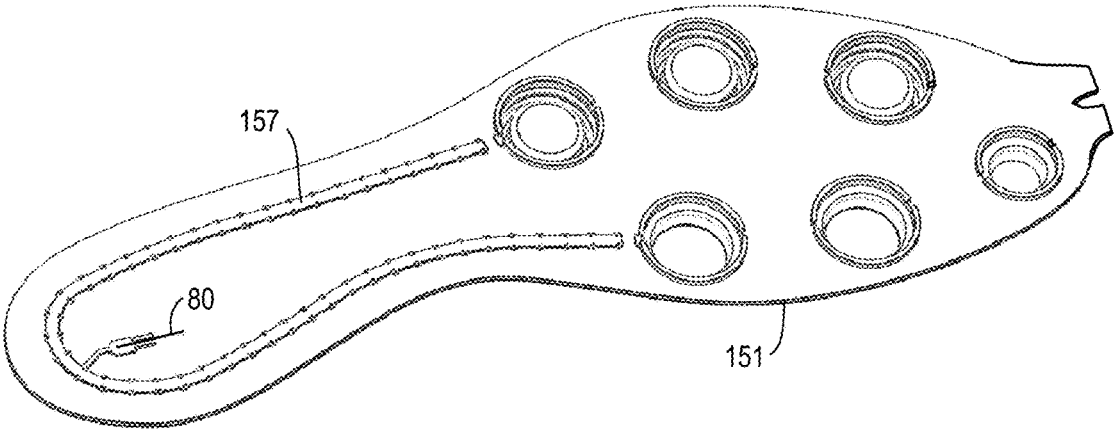
FIG. 6B shows the first layer of FIG. 6A after attachment of the second electrode of FIG. 6A.
Figure 6C:
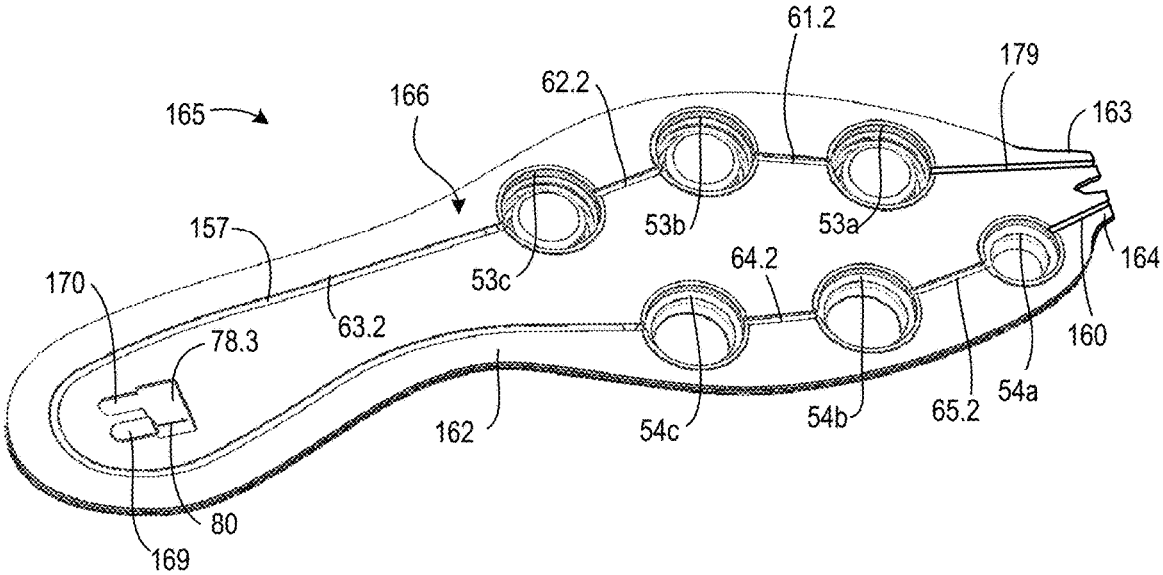
FIG. 6C shows the second component of the incline adjuster of FIG. 4A after molding of a second layer over the first layer and attached second electrode.

FIGS. 6A through 6C illustrate steps in forming the top component of incline adjuster 16. First, and as shown in FIG. 6A, a first layer 151 is injection molded. Layer 151 will form the top layer of the top component. The perimeter of layer 151 has a shape that, except for extensions 153 and 154, is the same as the shape of the perimeter of main body 51. Layer 151 is continuous. The top surface 155 of layer 151 includes a raised portion 156. Raised portion 156 has a shape that corresponds to, and that defines a seat for, a top electrode 157. As also seen in FIG. 6A, layer 151 includes countered walls 53 and 54, which are joined to the remaining portions of layer 151 around their edges. In some embodiments, walls 53 and 54 are injection molded simultaneously with other portions of layer 151. In other embodiments such as embodiments discussed below in connection with FIGS. 14C through 16F, walls of chambers may be separately molded and the remaining portions of layer 151 then molded onto those walls.

In FIG. 6A, layer 151 is inverted from the orientation of incline adjuster 16 in FIG. 4A. In particular, the bottom side of layer 151 is visible in FIG. 6A. Portions of the top side of layer 151 surrounding walls 53 and 54, which portions are not visible in FIG. 6A, will form top 52 of main body 51 in the completed incline adjuster 16. Extensions 153 and 154 will form portions of the necks that will have the sprues through which incline adjuster 16 may be filled with ER fluid 69.

Top electrode 157 is also shown in FIG. 6A. Electrode 157 is also a continuous metal sheet and may be formed from the same material used to form electrode 107. Electrode 157 includes a pad 158 for attachment of an electrical lead. Edges of electrode 157 also include a series of slots 159 formed along both edges. Exemplary dimensions for slots 159 may be the same as those of slots 109 in electrode 107.

Electrode 157 is attached to raised portion 156 in FIG. 6B. In some embodiments, a PSA may be applied to a top surface of electrode 157 and/or to a bottom surface of raised portion 156 to hold electrode 157 in place during a subsequent molding operation (described below). Lead 80 may be put in place and attached to pad 158 by soldering, by using conductive epoxy, or by other technique.

After attachment of electrode 157 and lead 80, a second layer 162 is overmolded onto layer 151. The resulting top component 165 of incline adjuster 16 is shown in FIG. 6C. Openings to interior regions of chambers 35 within walls 53 and to interior regions of chamber 36 within walls 54 are defined in a bottom surface 166 of top component 165. Top portions 61.2, 62.2, 63.2, 64.2, and 65.2 of transfer channels 61, 62, 63, 64, and 65, respectively, are also formed in bottom surface 166. A portion of electrode 157 is exposed in top portion 63.2. A depression 78.3 in surface 166 will align with openings 78.1 and 78.1 to form a cavity exposing leads 79 and 80. Layer 162 also includes extensions 163 and 164 that overlay extensions 153 and 154 of layer 151. A channel 179 in extension 163 will form a portion of a lateral side sprue. A channel 160 in extension 164 will form a portion of a medial side sprue. A raised region 169, which extends from bottom surface 166 over lead 80, will fit into depression 120 in top surface 116 of bottom component 115. A depression 170 is formed in bottom surface 166 to accept raised region 119 in top surface 116 of bottom component 115.

In some embodiments, layer 151 may be injection molded from TPU. Layer 162 may be overmolded onto layer 151 (with attached electrode 157 and lead 80) by injection molding of additional TPU. Layers 151 and 162 may be formed from the same type of TPU used to form layers 101 and 112, or may be formed from a different type of TPU.

Figure 7:
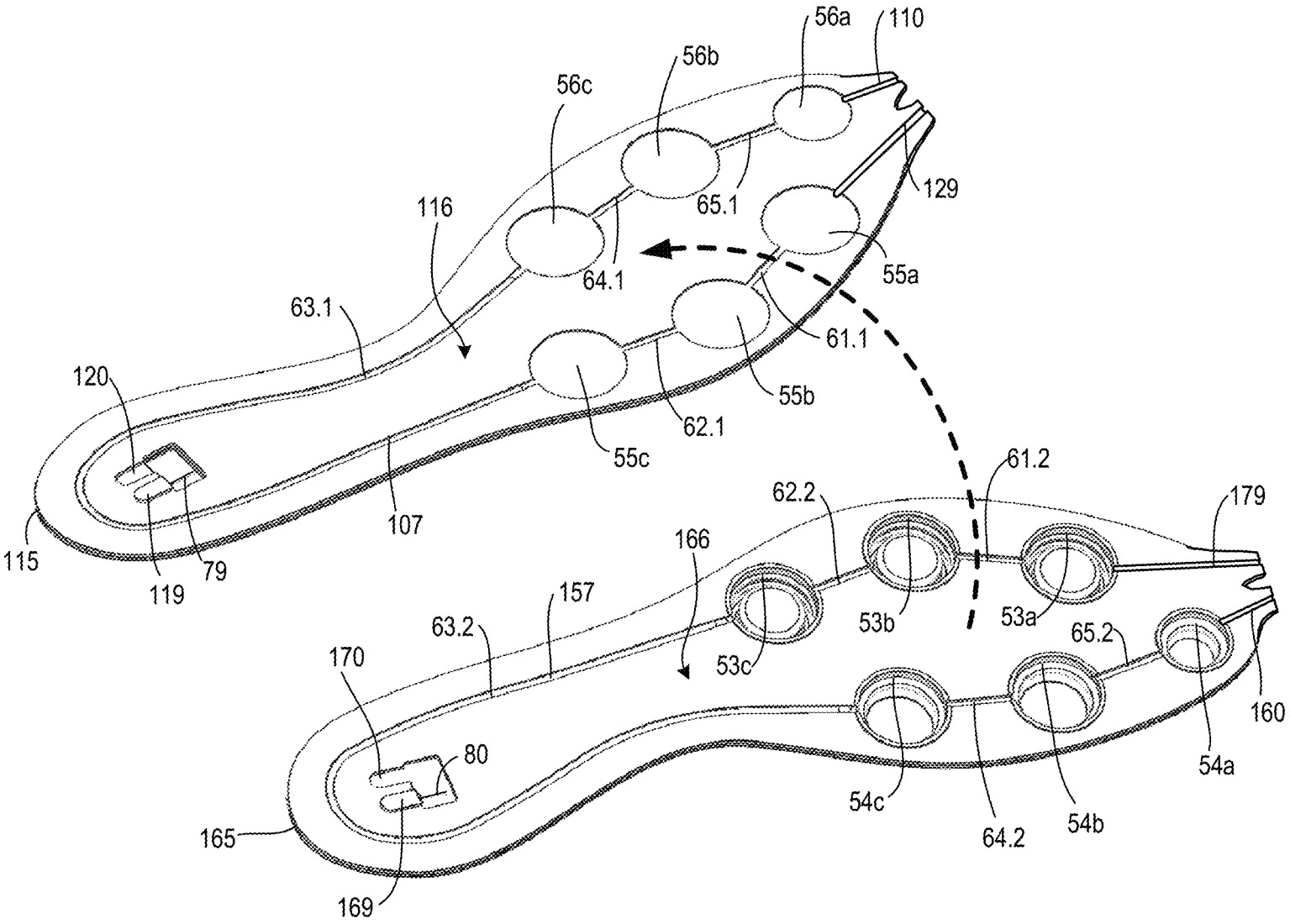
FIG. 7 shows assembly of the incline adjuster of FIG. 4A from the first component of FIG. 5C and the second component of FIG. 6C.

FIG. 7 shows assembly of incline adjuster 16 after fabrication of bottom component 115 and top component 116. Bottom surface 166 of top component 165 is placed into contact with top surface 116 of bottom component 115. Components 115 and 165 are assembled so that bottom portions 61.1 through 65.1 are respectively aligned with top portions 61.2 through 65.2 to respectively form transfer channels 61 through 65, regions 55*a* through 55*c* are respectively aligned with the openings to cavity interiors bounded by walls 53*a* through 53*c* to respectively form lateral chambers 35*a*-35*c*, regions 56*a* through 56*c* are respectively aligned with the openings to cavity interiors bounded by walls 54*a* through 54*c* to respectively form medial chambers 36*a* through 36*c*, raised region 119 is located within depression 170, and raised region 169 is located in depression 120. Bottom surface 166 of top component 165 may be bonded to top surface 116 of bottom component 115 by RF welding. In some embodiments, surfaces 166 and 116 may be bonded using adhesive application.

Figure 8A:
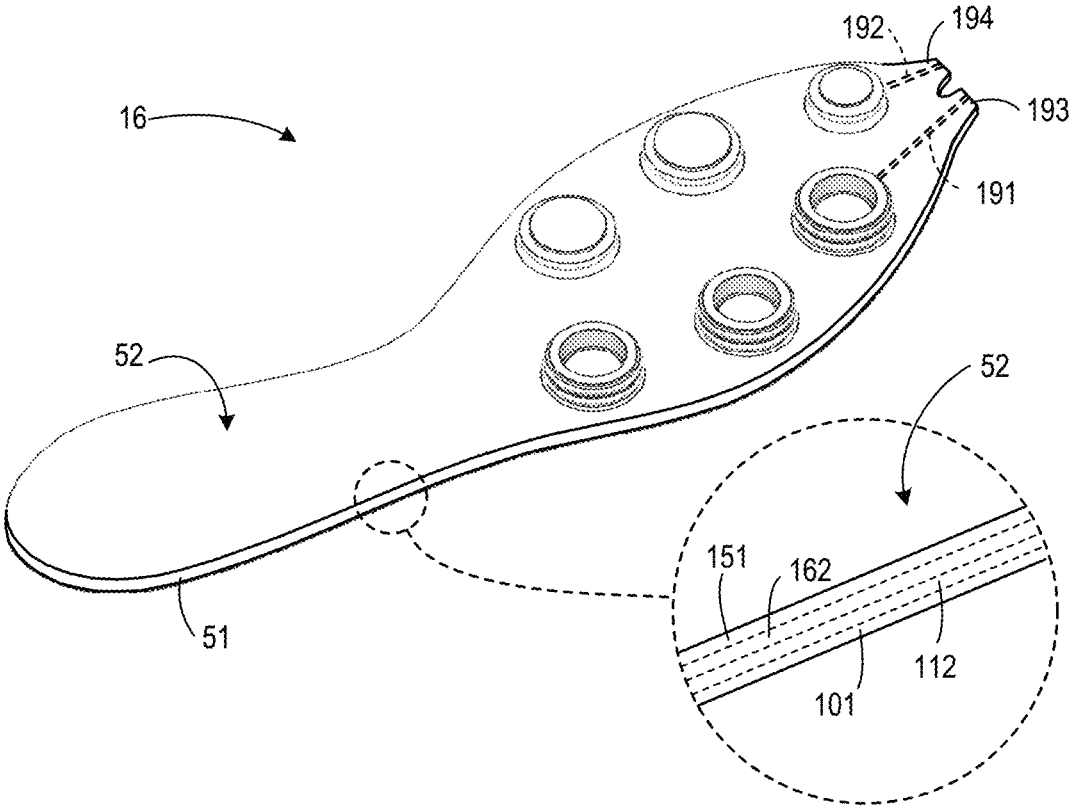
FIG. 8A is a lateral top perspective view of an incline adjuster after assembly and prior to filling with ER fluid.

FIG. 8A is a lateral top perspective view of incline adjuster 16 after bonding of components 115 and 165, but prior to filling incline adjuster 16 with ER fluid 69. For purposes of illustration, the locations of layers 101, 112, 151, and 162 are indicated in the enlarged inset portion of FIG. 8A. However, in at least some embodiments (e.g., when the same material of the same color is used for all layers), individual layers may not be distinguishable in incline adjuster 16.

Neck 193 is formed by extensions 103 and 113 of layers 101 and 112, respectively, as well as by extensions 153 and 163 of layers 151 and 162, respectively. A sprue 191, formed by channels 129 and 179, provides a passage into lateral chamber 35*a*. Neck 194 is formed by extensions 104 and 114 of layers 101 and 112, respectively, as well as by extensions 154 and 164 of layers 151 and 162, respectively. A sprue 192, formed by channels 110 and 160, provides a passage into medial chamber 36*a*. Sprues 191 and 192 are indicated in FIG. 8A with broken lines, but for simplicity the locations of transfer channels and other internal structures of incline adjuster 116 are not indicated. ER fluid 69 may be then injected through one of sprues 191 or 192 until it flows out of the other of sprues 191 or 192. In some embodiments, a degassing procedure such as is described in U.S. Patent Application Publication No. 2017/0150785 (incorporated by reference herein) may be used. In some embodiments, a degassing procedure such as is described in a U.S. Provisional Patent Application titled "Degassing Electrorheological Fluid" (filed on the same date as the present application (incorporated by reference herein) may be employed. After filling and degassing, sprues 191 and 192 may be sealed (e.g., by RF welding across sprues 191 and 192), thus sealing an internal volume formed by the internal volumes of chambers 35*a* through 35*c*, chambers 36*a* through 36*c*, and transfer channels 61 through 65. Portions of necks 193 and 194 forward of the seals may then be trimmed away to achieve the outer perimeter shape of the forefoot portion of incline adjuster 16 that is shown in FIG. 4B.

Figure 8B:
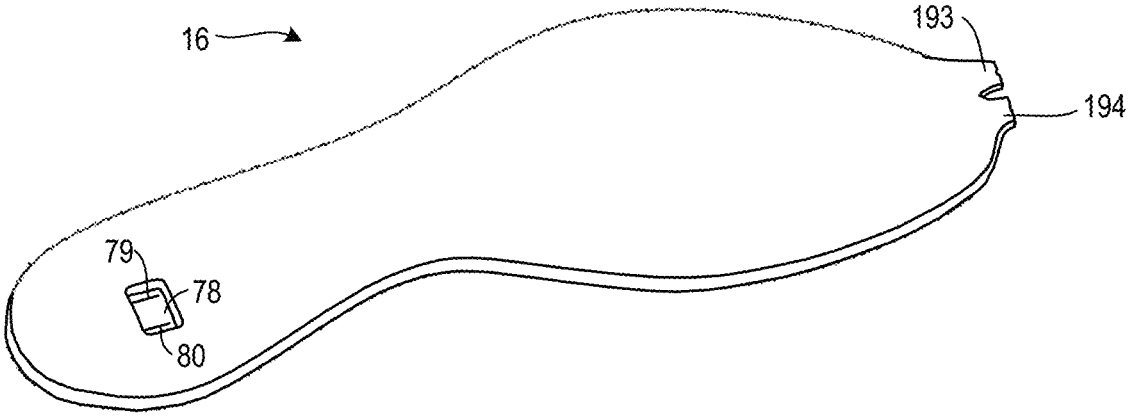
FIG. 8B is a bottom medial perspective view of an incline adjuster after assembly and prior to filling with ER fluid.

FIG. 8B is bottom medial perspective view of incline adjuster 16 after assembly and prior to filling with ER fluid. Cavity 78 on the bottom side is formed by the alignment of depression 78.3 (layer 162, FIG. 6C) with openings 78.2 (layer 112, FIG. 5C) and 78.1 (layer 101, FIG. 5A). Leads 79 and 80 are exposed in cavity 78 for connection to converter 45.

Figure 9:
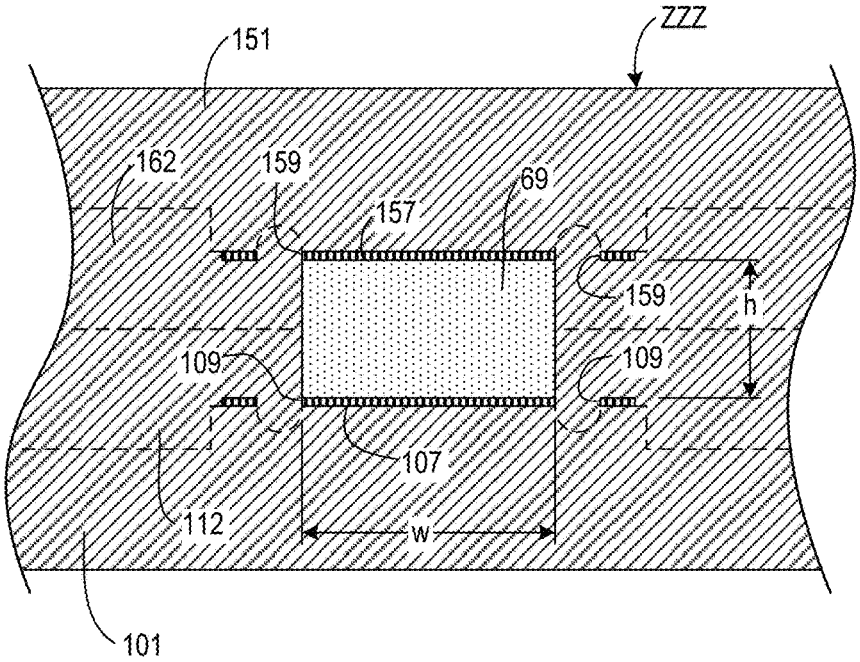
FIG. 9 is an enlarged area cross-sectional view, taken from the plane indicated in FIG. 4B by arrows C-C, showing of a portion of a transfer channel of the incline adjuster of FIG. 4A.

FIG. 9 is an enlarged area cross-sectional view taken from the plane indicated in FIG. 4B by arrows C-C. FIG. 9 shows of a portion of transfer channel 63 located within field-generating portion 77, as well as additional details of embedded electrodes 107 and 157. The locations of layers 101, 112, 151, and 162 are indicated with broken lines. Bottom electrode 107 spans the bottom of transfer channel 63 in field-generating portion 77. Top electrode 157 spans the top of transfer channel 63 in field generating portion 77. Side edges of electrodes 107 and 157 extend beyond the sides of transfer channel 63 and into the material of main body 51. As seen in FIG. 9, the material of main body 51 has flowed into, and solidified within, slots 109 and 159 and anchors electrodes 107 and 157 in place. In some embodiments, transfer channel 63 may have a maximum height h between electrodes of 1 millimeter (mm) and an average width (w) of 2 mm. The maximum height h (between top and bottom walls) and average width w of transfer channels 61, 62, 64, and 65 may have the same dimensions.

Figure 10:
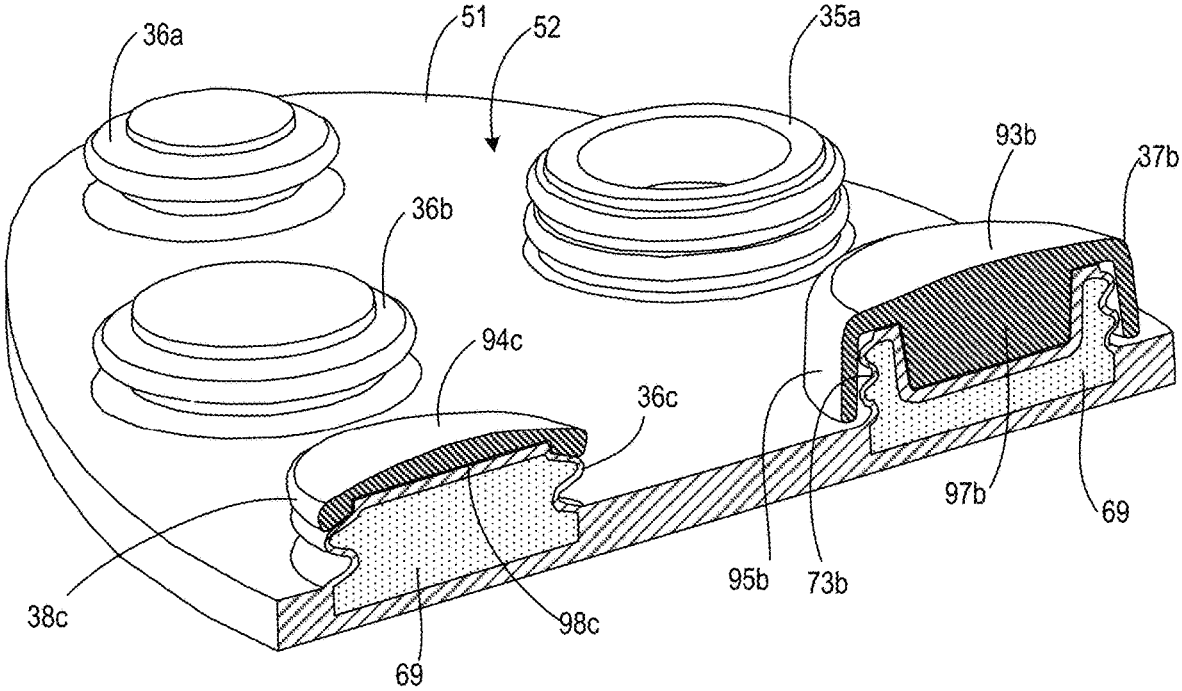
FIG. 10 is a partially schematic cross-sectional view, taken as a top rear medial perspective view from the plane indicated in FIG. 4B by arrows A-A, and further showing two chamber caps.

FIG. 10 is a partially schematic cross-sectional view, taken as a top rear medial perspective view from the plane indicated in FIG. 4B by arrows A-A. Chamber cap 38*c* is in position on chamber 36*c* and chamber cap 37*b* is in position on chamber 35*b*. Chamber cap 38*c* includes a depression 98*c* that receives a disc-shaped portion at the top exterior of wall 54*c*. Chamber cap 37*b* includes a protrusion 97*b* that nests within the external depression in the top of chamber 35*b*, and a skirt 95*b* that surrounds outer side wall 73*b*.

Each of chamber caps 38*a* and 38*b* has a structure similar to that of chamber cap 38*c*. Each of chamber caps 37*a* and 37*c* has a structure similar to that of chamber cap 37*b*. Although other chamber caps are omitted from FIG. 10 for convenience, in an assembled shoe 10 chambers caps 38*a* and 38*b* would be respectively positioned on chambers 36*a* and 36*b* in a manner similar to that indicated for chamber cap 38*c* and chamber 36*c*, and chambers caps 35*a* and 35*c* would be respectively positioned on chambers 35*a* and 35*c* in a manner similar to that indicated for chamber cap 37*b* and chamber 35*b*.

Top surfaces of chamber caps 37*a* through 37*c* and 38*a* through 38*c*, including top surface 94*c* of chamber cap 38*c* and top surface 93*b* of chamber cap 37*b*, have rounded and convex shapes. These shapes ease movement of chamber caps across the bottom surface of top support plate 41, and also provide a cam action against plate 41. In some embodiments, at least the top surfaces 93 and 94 of chamber caps 37 and 38 are formed from a material that has a coefficient of friction, relative to the bottom surface of support plate 41, that is less than a coefficient of friction, relative to the bottom surface of support plate 41, of material forming walls 53 and 54. In some embodiments, caps 37 and 38 may be formed from polycarbonate (PC), a blend of PC and acrylonitrile butadiene styrene (ABS), or acetal homopolymer.

Figure 11:
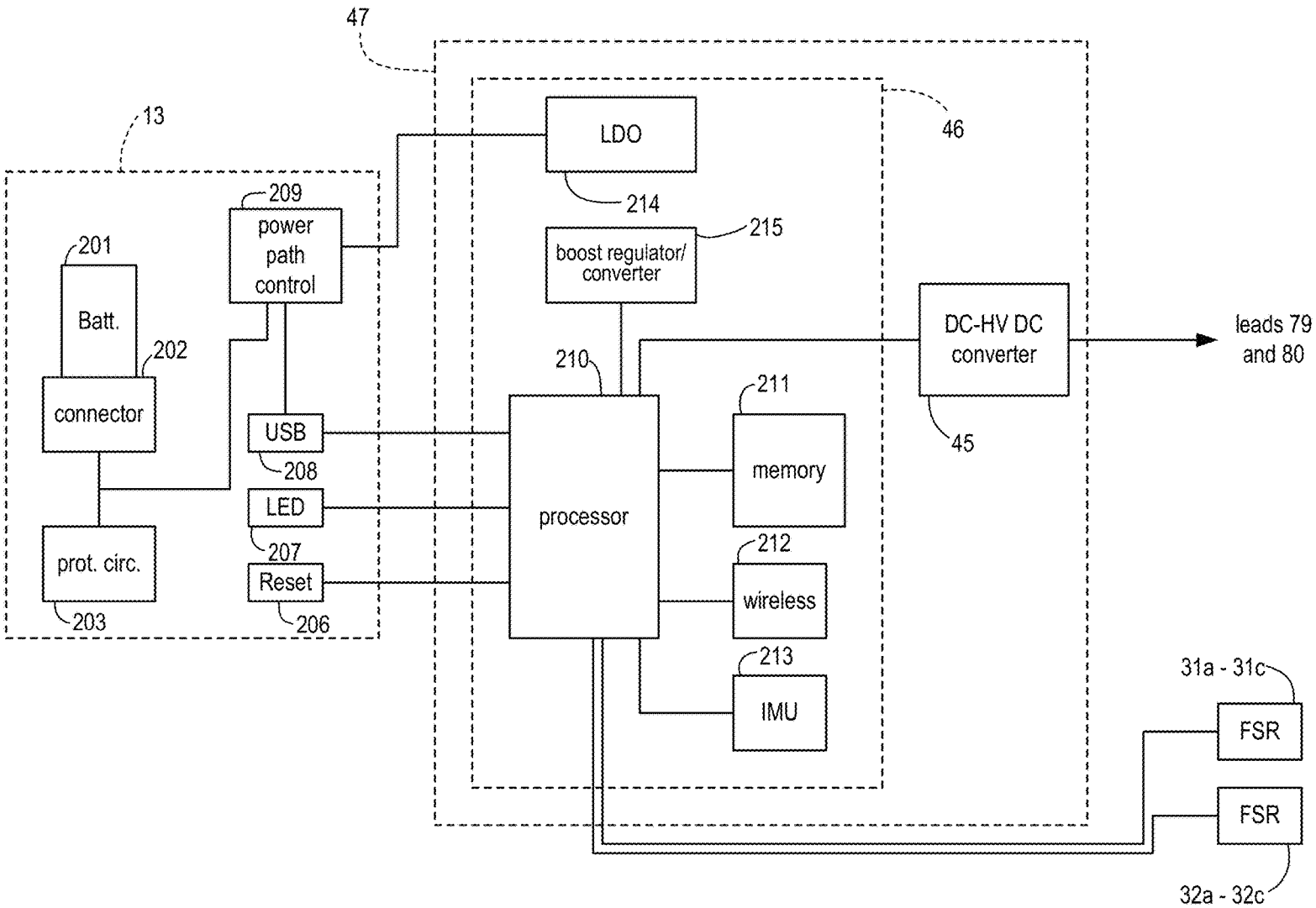
FIG. 11 is a block diagram showing electrical system components in the shoe of FIG. 1.

FIG. 11 is a block diagram showing electrical system components of shoe 10. Individual lines to or from blocks in FIG. 11 represent signal (e.g., data and/or power) flow paths and are not necessarily intended to represent individual conductors. Battery pack 13 includes a rechargeable lithium ion battery 201, a battery connector 202, and a lithium ion battery protection IC (integrated circuit) 203. Protection IC 203 detects abnormal charging and discharging conditions, controls charging of battery 201, and performs other conventional battery protection circuit operations. Battery pack 13 also includes a USB (universal serial bus) port 208 for communication with controller 47 and for charging battery 201. A power path control unit 209 controls whether power is supplied to controller 47 from USB port 208 or from battery 201. An ON/OFF (O/O) button 206 activates or deactivates controller 47 and battery pack 13. An LED (light emitting diode) 207 indicates whether the electrical system is ON or OFF. The above-described individual elements of battery pack 13 may be conventional and commercially available components that are combined and used in the novel and inventive ways described herein.

Controller 47 includes the components housed on PCB 46, as well as converter 45. In other embodiments, the components of PCB 46 and converter 45 may be included on a single PCB, or may be packaged in some other manner. Controller 47 includes a processor 210, a memory 211, an inertial measurement unit (IMU) 213, and a low energy wireless communication module 212 (e.g., a BLUETOOTH communication module). Memory 211 stores instructions that may be executed by processor 210 and may store other data. Processor 210 executes instructions stored by memory 211 and/or stored in processor 210, which execution results in controller 47 performing operations such as are described herein. As used herein, instructions may include hard-coded instructions and/or programmable instructions.

IMU 213 may include a gyroscope and an accelerometer and/or a magnetometer. Data output by IMU 213 may be used by processor 210 to detect changes in orientation and motion of shoe 10, and thus of a foot wearing shoe 10. As explained in more detail below, processor 210 may use such information to determine when an incline of a portion of shoe 10 should change. Wireless communication module 212 may include an ASIC (application specific integrated circuit) and be used to communicate programming and other instructions to processor 210, as well as to download data that may be stored by memory 211 or processor 210.

Controller 47 includes a low-dropout voltage regulator (LDO) 214 and a boost regulator/converter 215. LDO 214 receives power from battery pack 13 and outputs a constant voltage to processor 210, memory 211, wireless communication module 212, and IMU 213. Boost regulator/converter 215 boosts a voltage from battery pack 13 to a level (e.g., 5 volts) that provides an acceptable input voltage to converter 45. Converter 45 then increases that voltage to a much higher level (e.g., 5000 volts) and supplies that high voltage across electrodes 107 and 157 of incline adjuster 16. Boost regulator/converter 215 and converter 45 are enabled and disabled by signals from processor 210. Controller 47 further receives signals from lateral FSRs 31*a* through 31*c* and from medial FSRs 32*a* through 32*c*. Based on those signals from FSRs 31 and 32, processor 210 determines whether forces from a wearer foot on lateral fluid chambers 35 and on medial fluid chambers 36 are creating a pressure within chambers 35 that is higher than a pressure within chambers 36, or vice versa.

The above-described individual elements of controller 47 may be conventional and commercially available components that are combined and used in the novel and inventive ways described herein. Moreover, controller 47 is physically configured, by instructions stored in memory 211 and/or processor 210, to perform the herein described novel and inventive operations in connection with controlling transfer of fluid between chambers 35 and 36 so as to adjust the incline of the forefoot portion of the shoe 10 footbed 14.

Figure 12A:
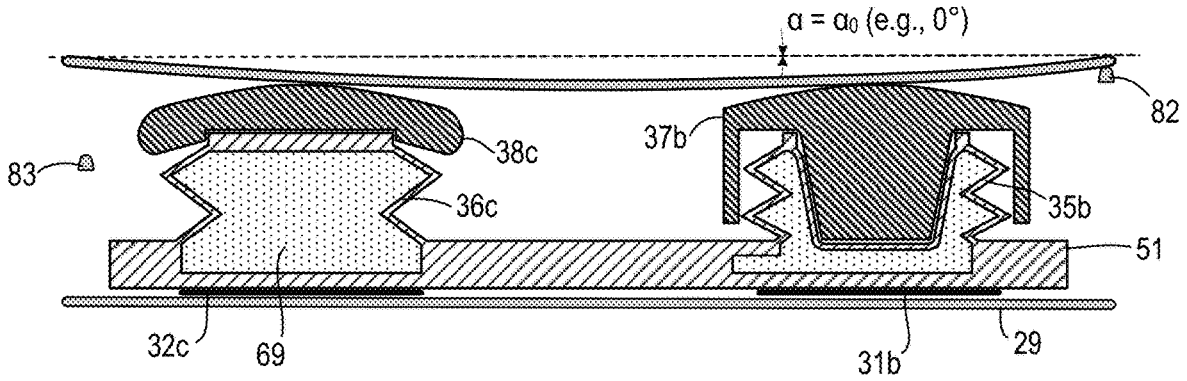
FIGS. 12A through 12C are partially schematic area cross-sectional diagrams showing operation of the incline adjuster of the shoe of FIG. 1 when going from a minimum incline condition to a maximum incline condition.
Figure 12B:
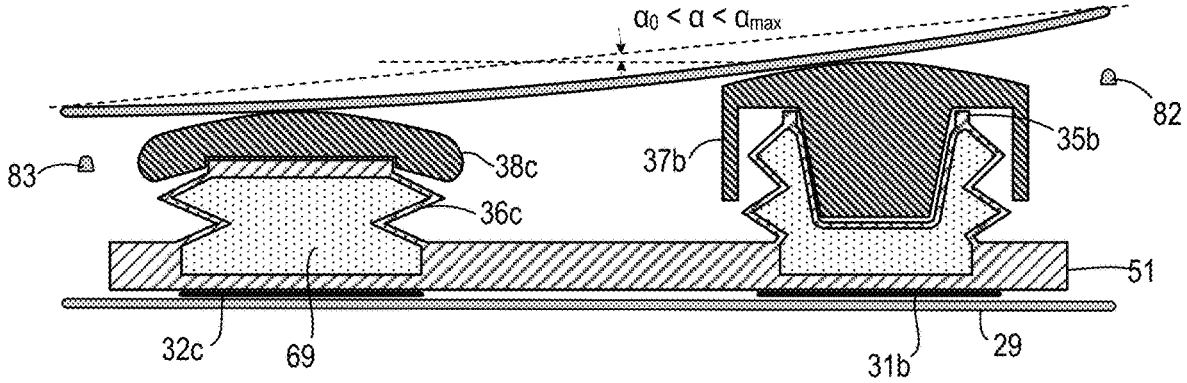
Figure 12C:
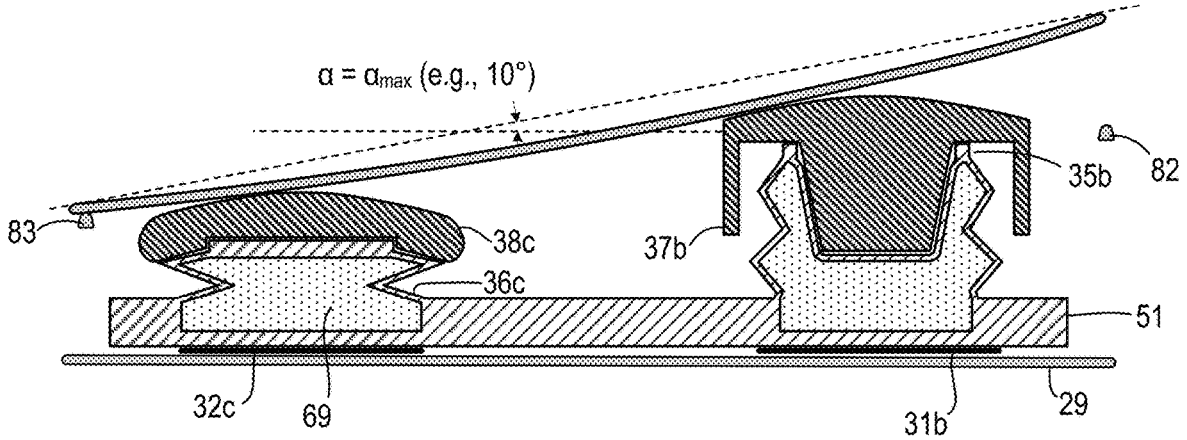

FIGS. 12A through 12C are partially schematic area cross-sectional diagrams showing operation of incline adjuster 16, according to some embodiments, when going from a minimum incline condition to a maximum incline condition. The position of the cross-sectional plane across incline adjuster 16 in FIGS. 12A through 12C is similar to that indicated by arrows A-A in FIG. 4B. Relative locations of bottom support plate 29, FSRs 32*c* and 31*b*, and top support plate 41 in a similar cross-sectional plat across an assembled shoe 10 are also indicated. Although none of the drawings are necessarily to scale, the proportions of certain elements represented in FIGS. 12A through 12C have been changed, relative to proportions depicted in other figures, for simplification.

In the minimum incline condition, an incline angle $\alpha$ of top plate 41 relative to bottom plate 29 has a value of $\alpha_{min}$ representing a minimum amount of incline sole structure 12 is configured to provide in the forefoot region. In some embodiments, $\alpha_{min}=0°$. In the maximum incline condition, the incline angle $\alpha$ has a value of $\alpha_{max}$ representing a maximum amount of incline sole structure 12 is configured to provide. In some embodiments, $\alpha_{max}$ is at least 5°. In some embodiments, $\alpha_{max}=10°$. In some embodiments, $\alpha_{max}$ may be greater than 10°.

In FIGS. 12A-12C, bottom plate 29, incline adjuster 16, top plate 41, FSR 31*b*, and FSR 32*c* are represented, but other elements are omitted for simplicity. Top plate 41 and other elements of sole structure 12 are configured so that downward force on plate 41 in a direction toward incline adjuster 16 is supported by medial chambers 36 and lateral chambers 35. Also indicated in FIGS. 12A through 12C are a medial side stop 83 and a lateral side stop 82. Medial side stop 83 supports the medial side of top plate 41 when incline adjuster 16 and top plate 41 are in the maximum incline condition. Lateral side stop 82 supports the lateral side of top plate 41 when incline adjuster 16 and top plate 41 are in the minimum incline condition. Lateral side stop 82 prevents top plate 41 from tilting toward the lateral side. Because runners proceed around a track in a counterclockwise direction during a race, a wearer of shoe 10 will be turning to his or her left when running on curved portions of a track. In such a usage scenario, there would be no need to incline the footbed of a right shoe sole structure toward the lateral side. In other embodiments, however, a sole structure may be tilted to either medial or lateral side.

In some embodiments, a left shoe from a pair that includes shoe 10 may be configured in a slightly different manner from what is shown in FIGS. 12A-12C. For example, a medial side stop may be at a height similar to that of lateral side stop 82 of shoe 10, and a lateral side stop may be at a height similar to that of medial side stop 83 of shoe 10. In such embodiments, the top plate of the left shoe moves between a minimum incline condition and maximum incline condition in which the top plate is inclined to the lateral side (i.e., the lateral side of the left shoe top plate will be lower than the medial side of the left shoe top plate at maximum inclination).

The locations of medial side stop 83 and of lateral side stop 82 are represented schematically in FIGS. 12A-12C, and are not shown in previous drawing figures. In some embodiments, lateral side stop 82 may be formed as a rim on the lateral side or edge of bottom plate 29. Similarly, medial side stop 83 may be formed as a rim on the medial side or edge of bottom plate 29.

FIG. 12A shows incline adjuster 16 when top plate 41 is in a minimum incline condition. Shoe 10 may be configured to place top plate 41 into the minimum incline condition when a wearer of shoe 10 is standing or is in starting blocks about to begin a race, or when the wearer is running a straight portion of a track. In FIG. 12A, controller 47 is maintaining the voltage across electrodes 107 and 157 at one or more flow-inhibiting voltage levels, wherein the voltage across electrodes 107 and 157 is high enough to generate an electrical field having a strength sufficient to increase the viscosity of ER fluid 69 in field-generating portion 77 of transfer channel 63 to a viscosity level that prevents flow between chambers 35*c* and 36*c*. In some embodiments, a flow-inhibiting voltage level is a voltage sufficient to create a field strength between electrodes 107 and 157 of between 3 kV/mm and 6 kV/mm. Because ER fluid 69 cannot flow through channel 63 under the conditions shown in FIG. 12A, the incline angle $\alpha$ of top plate 41 does not change if the wearer of shoe 10 shifts weight between medial and lateral sides of shoe 10.

FIG. 12B shows incline adjuster 16 soon after controller 47 has determined that top plate 41 should be placed into the maximum incline condition, i.e., inclined to $\alpha=\alpha_{max}$. In some embodiments, and as explained below, controller 47 makes such a determination based on a number of steps taken by the shoe 10 wearer. Upon determining that top plate 41 should be inclined to $\alpha_{max}$, controller 47 determines if the foot wearing shoe 10 is in a portion of the wearer gait cycle in which shoe 10 is in contact with the ground. Controller 47 also determines if a difference $\Delta P_{M-L}$ between the pressure $P_M$ of ER fluid 69 in medial side chambers 36 and the pressure $P_L$ of ER fluid 69 in lateral side chambers 35 is positive, i.e., if $P_M-P_L$ is greater than zero. If shoe 10 is in contact with the ground and $\Delta P_{M-L}$ is positive, controller 47 reduces the voltage across electrodes 107 and 157 to a flow-enabling voltage level. In particular, the voltage across electrodes 107 and 157 is reduced to a level that is low enough to reduce the strength of the electrical field in transfer channel 63 so that the viscosity of ER fluid 69 in transfer channel 63 is at a normal viscosity level.

Upon reducing the voltage across electrodes 107 and 157 to a flow-enabling voltage level, the viscosity of ER fluid 69 in channel 63 drops. ER fluid 69 then begins flowing out of chambers 36 and into chambers 35. This allows the medial side of top plate 41 to begin moving toward bottom plate 29, and the lateral side of top plate 41 to begin moving away from bottom plate 29. As a result, the incline angle $\alpha$ begins to increase from $\alpha_{min}$.

In some embodiments, controller 47 determines if shoe 10 is in a step portion of the gait cycle and in contact with the ground based on data from IMU 213. In particular, IMU 213 may include a three-axis accelerometer and a three-axis gyroscope. Using data from the accelerometer and gyroscope, and based on known biomechanics of a runner foot, e.g., rotations and accelerations in various directions during different portions of a gait cycle, controller 47 can determine whether the right foot of the shoe 10 wearer is stepping on the ground. Controller 47 may determine if $\Delta P_{M-L}$ is positive based on the signals from FSRs 31*a* through 31*c* and FSRs 32*a* through 32*c*. Each of those signals corresponds to magnitude of a force from a wearer foot pressing down on the FSR. Based on the magnitudes of those forces and on the known dimensions of chambers 35 and 36, controller 47 can correlate the values of signals from FSRs 31 and FSRs 32 to a magnitude and a sign of $\Delta P_{M-L}$. In some embodiments, the sum of the medial FSRs 31 are utilized as value of the medial pressure $P_M$ and the sum of the lateral FSRs 32 are utilized as the value of the lateral pressure $P_L$. The pressure difference in then calculated to determine the electrode voltage state.

FIG. 12C shows incline adjuster 16 very soon after the time associated with FIG. 12B. In FIG. 7C, top plate 41 has reach the maximum incline condition. In particular, the incline angle α of top plate 41 has reached $\alpha_{max}$. Medial stop 83 prevents incline angle α from exceeding $\alpha_{max}$. Very soon after the time associated with FIG. 7C, controller 47 raises the voltage across electrodes 107 and 157 to a flow-inhibiting voltage level. This prevents further flow through transfer channel 63 and holds top plate 41 in the maximum incline condition. During a normal gait cycle, downward force of a right foot on a shoe is initially higher on the lateral side as the forefoot rolls to the medial side. If flow through channel 63 were not prevented, the initial downward force on the lateral side of the wearer right foot would decrease incline angle α.

Figure 13A:
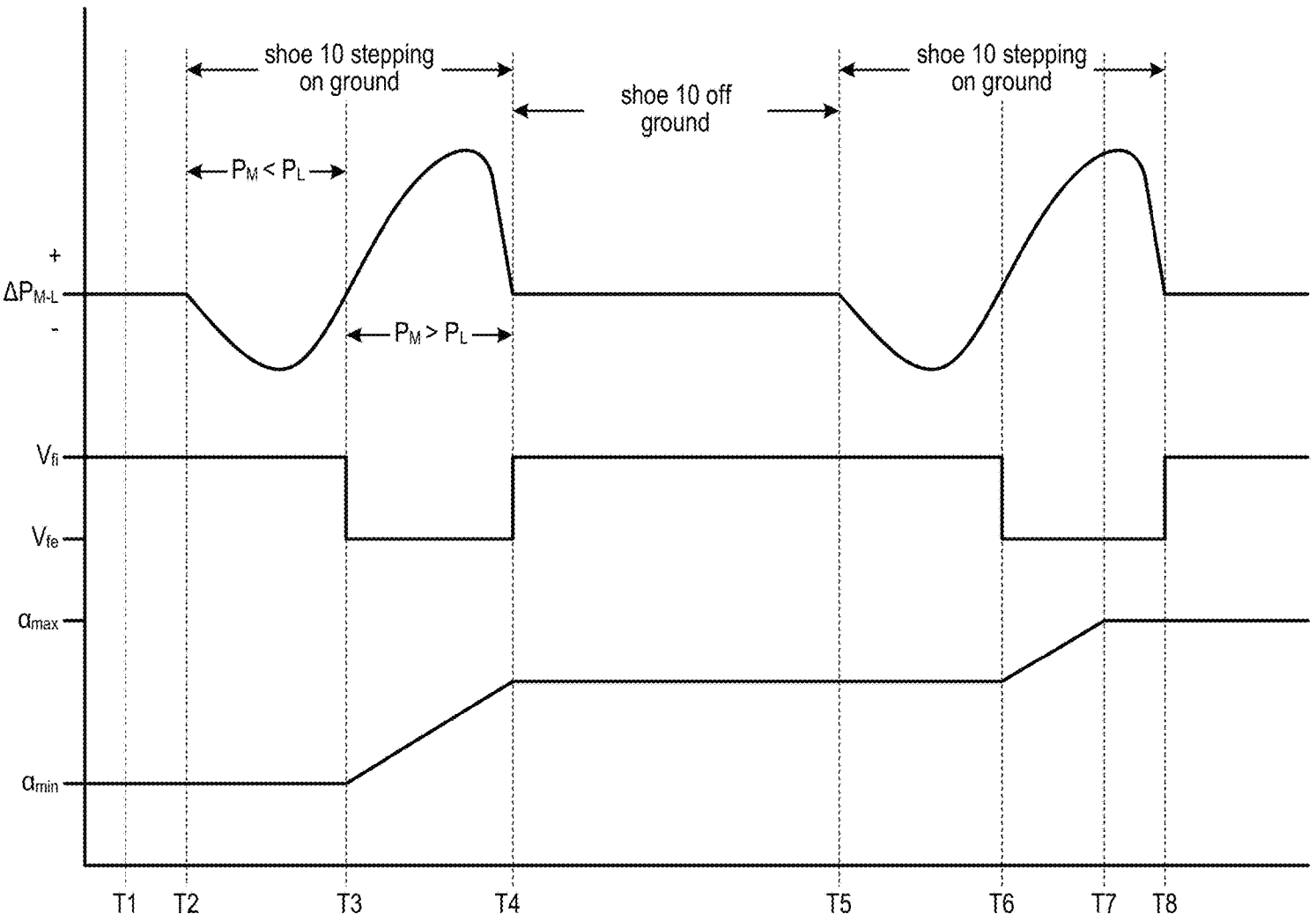
FIG. 13A is a graph of foot state, pressure difference, voltage levels, and incline angle at different times during a transition from a minimum incline condition to a maximum incline condition.

In some embodiments, a wearer of shoe 10 may be required to take several steps in order for top plate 41 to reach maximum incline. Accordingly, controller 47 may be configured to raise the voltage across electrodes 107 and 157 when controller 47 determines (based on data from IMU 213 and FSRs 31 and 32) that the wearer foot has left the ground. Controller 47 may then drop that voltage when it again determines that shoe 10 is stepping on the ground and $\Delta P_{M-L}$ is positive. This can be repeated for a predetermined number of steps. This is illustrated in FIG. 13A, a graph of medial-lateral pressure difference $\Delta P_{M-L}$, voltage across electrodes 107 and 157, and incline angle α at different times during a transition from a minimum incline condition to a maximum incline condition.

At time T1, controller 47 determines that top plate 41 of shoe 10 should transition to the maximum incline condition. At time T2, controller 47 determines that shoe 10 is stepping on the ground, but that $\Delta P_{M-L}$ is negative. At time T3, controller 47 determines that shoe 10 is stepping on the ground and that $\Delta P_{M-L}$ is positive, and controller reduces the voltage across electrodes 107 and 157 to a flow-enabling voltage level. As a result, incline angle α of top plate 41 begins to increase from $\alpha_{min}$. At time T4, controller 47 determines that shoe 10 is no longer stepping on the ground, and controller raises the voltage across electrodes 107 and 157 to a flow-inhibiting voltage level. As a result, incline angle α holds at its current value. At time T5, controller 47 again determines that shoe 10 is stepping on the ground, but that $\Delta P_{M-L}$ is negative. At time T6, controller 47 determines that shoe 10 is stepping on the ground and that $\Delta P_{M-L}$ is positive, controller 47 again reduces the voltage across electrodes 107 and 157 to a flow-enabling voltage level, and incline angle α resumes increasing. At time T7, incline angle α reaches $\alpha_{max}$. Incline angle α stops increasing because further tilting of top plate 41 is prevented by medial stop 83. At time T8, controller 47 determines that shoe 10 is no longer stepping on the ground, and controller 47 again raises the voltage across electrodes 107 and 157 to a flow-inhibiting voltage level. Controller 47 maintains that voltage at a flow-inhibiting voltage level through further step cycles until controller 47 determines that top plate 41 should transition to the minimum incline condition.

Figure 13B:
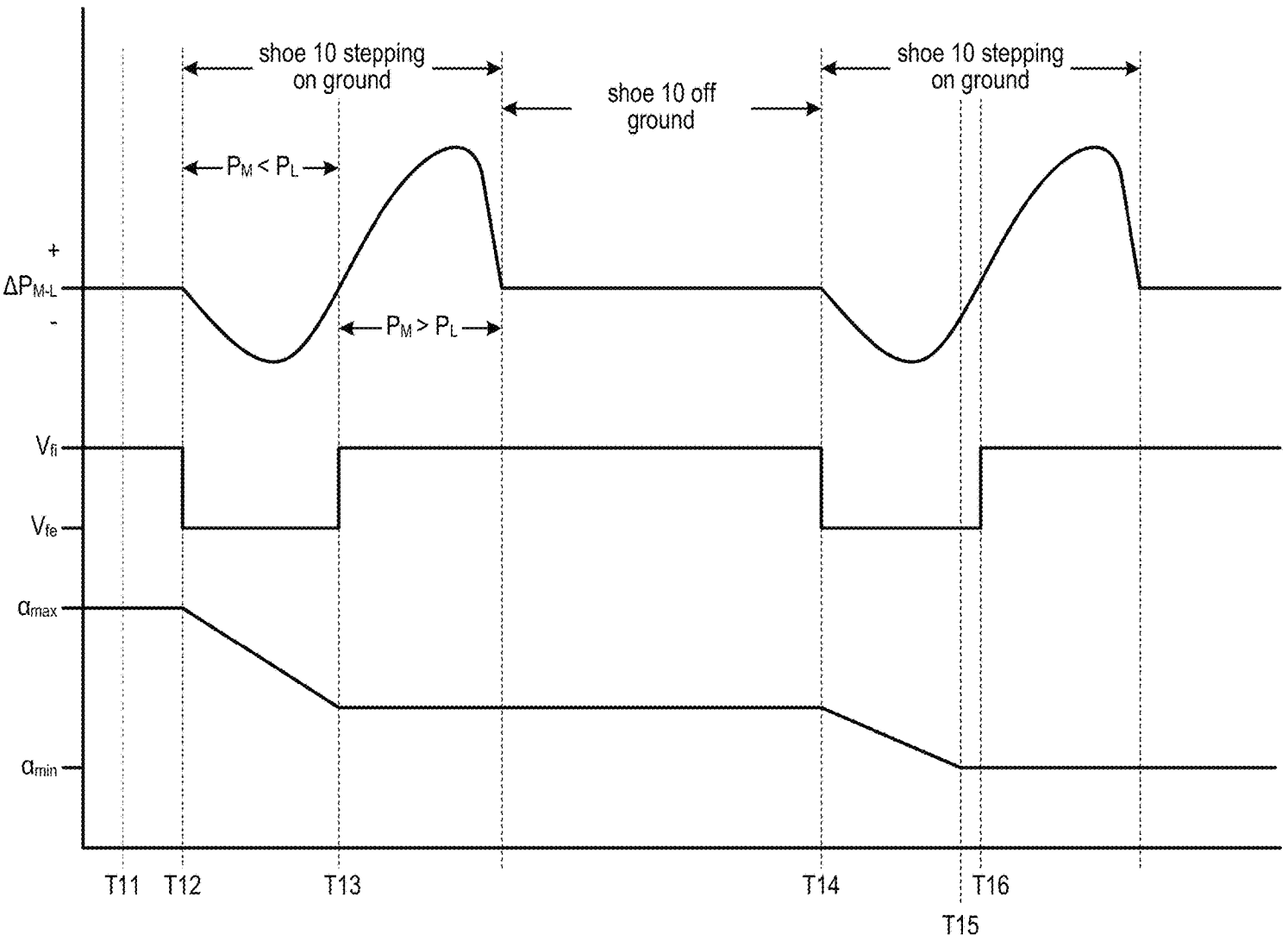
FIG. 13B is a graph of foot state, pressure difference, voltage levels, and incline angle at different times during a transition from a maximum incline condition to a minimum incline condition.

FIG. 13B is a graph of medial-lateral pressure difference $\Delta P_{M-L}$, voltage across electrodes 107 and 157, and incline angle α at different times during a transition from a maximum incline condition to a minimum incline condition. At time T11, controller 47 determines that top plate 47 of shoe 10 should transition to the minimum incline condition. At time T12, controller 47 determines that shoe 10 is stepping on the ground and that $\Delta P_{M-L}$ is negative, and controller 47 decreases the voltage across electrodes 107 and 157 to a flow-enabling voltage level. As a result, and because a negative $\Delta P_{M-L}$ represents a pressure $P_{lat}$ in lateral chambers 35 that is higher than a pressure $P_{med}$ in medial chambers 36, ER fluid 59 begins to flow out of lateral chambers 35 and into medial chambers 36, and incline angle α begins to decrease from $\alpha_{max}$. At time T13, controller 47 determines that shoe 10 is stepping on the ground but that $\Delta P_{M-L}$ is positive, and controller 47 increases the voltage across electrodes 107 and 157 to a flow-inhibiting voltage level. As a result, incline angle α of top plate 41 holds. At time T14, controller 47 determines that shoe 10 is again stepping on the ground and that $\Delta P_{M-L}$ is negative, and controller 47 lowers the voltage across electrodes 107 and 157 to a flow-enabling voltage level. As a result, incline angle α continues to decrease. At time T15, incline angle α reaches $\alpha_{min}$. Incline angle α stops decreasing because further tilting of top plate 41 is prevented by lateral stop 82. At time T16, controller 47 determines that $\Delta P_{M-L}$ is positive, and controller 47 again increases the voltage across electrodes 107 and 157 to a flow-inhibiting voltage level. Controller 47 maintains that voltage at a flow-inhibiting voltage level through further step cycles until controller 47 determines that top plate 41 should transition to the maximum incline condition.

In the above example, controller 47 lowered the voltage across electrodes 107 and 157 during two step cycles to transition between incline conditions. In other embodiments, however, controller 47 may lower that voltage during fewer or more step cycles. The number of step cycles to transition from minimum incline to maximum incline may not be the same as the number of step cycles to transition from maximum incline to minimum incline.

In some embodiments, controller 47 makes the determination of when to transfer to maximum incline position by counting the number of steps taken since initialization, and determining if that number of steps is enough to have located the shoe 10 wearer in a portion of a track bend. Typically, track athletes are very consistent in the lengths of their strides. Track dimensions and distances from the starting line to the bends in each track lane are known quantities that can be stored by controller 47. Based on input from a shoe 10 wearer to controller 47 indicating the track lane assigned to that shoe 10 wearer, as well as input indicating the length of that wearer's stride, controller 47 can determine the wearer's track location by keeping a running count of steps taken. As discussed above, controller 47 can determine where shoe 10 may be within a gait cycle based on data from IMU 213. These gait cycle determinations can indicate when a step has been taken.

In some embodiments, a left shoe of the pair that includes shoe 10 may operate in a manner similar to that described above for shoe 10, but with a maximum incline condition representing a maximum inclination of the left shoe top plate toward the lateral side. Operations performed by the left shoe controller would be similar to those described above in connection with FIGS. 13A through 13B, but with determinations based on the sign of $\Delta P_{M-L}$ instead based on the sign of $\Delta P_{L-M}=P_L-P_M$, where $P_L$ is a pressure in the left shoe lateral fluid chamber and $P_M$ is a pressure in the left shoe medial fluid chamber.

In some embodiments, a shoe controller may determine when to transition from minimum incline to maximum incline, and vice versa, based on other types of inputs. In some such embodiments, for example, a shoe wearer may wear a garment that includes one or more IMUs located on the wearer's torso and/or at some other location displaced from the shoe. Output of those sensors could be communicated to the shoe controller over a wireless interface similar to wireless module 212 (FIG. 11). Upon receiving output from those sensors indicating that the wearer has a assumed a body position consistent with a need to incline a shoe top plate (e.g., as the wearer's body tilts to the side when running on a track bend), the controller can perform operations to incline a shoe top plate. In still other embodiments, a shoe controller may determine location in some other manner (e.g., based on GPS signals).

A controller need not be located within a sole structure. In some embodiments, for example, some or all components of a controller could be located with the housing of a battery assembly such as battery assembly 13 and/or in another housing positioned on a footwear upper.

In some embodiments, and as indicated above, bottom component 115 and top component 165 may each be formed during a multi-shot injection molding process. This process in shown schematically in FIGS. 14A and 14B. In a first set of operations to form layers 101 and 151 shown in FIG. 14A, bottom molds 301 and 302 and a first set of top molds 303 and 304 are used. A surface on bottom mold 301 has a contour that corresponds to a reverse of, and that will form, the bottom surface and side edge of layer 101. A surface on top mold 303 has a contour that corresponds to a reverse of, and that will form, the top surface of layer 101. In operation (1*a*), molds 301 and 303 are brought together. In operation (2*a*), molten TPU (or other material) is injected, and that material is allowed to harden into layer 101. In operation (3*a*), mold 303 is removed, layer 101 remains in mold 301, and electrode 107 and lead 79 are placed onto layer 101. A surface on bottom mold 302 has a contour that corresponds to a reverse of, and that will form, the top surface and side edge of layer 151. A surface on top mold 304 has a contour that corresponds to a reverse of, and that will form, the bottom surface of layer 151. In operation (1*b*), molds 302 and 304 are brought together. In operation (2*b*), molten TPU (or other material) is injected, and that material is allowed to harden into layer 151. In operation (3*b*), mold 304 is removed, layer 151 remains in mold 302, and electrode 157 and lead 80 are placed onto layer 151.

Figure 14A:
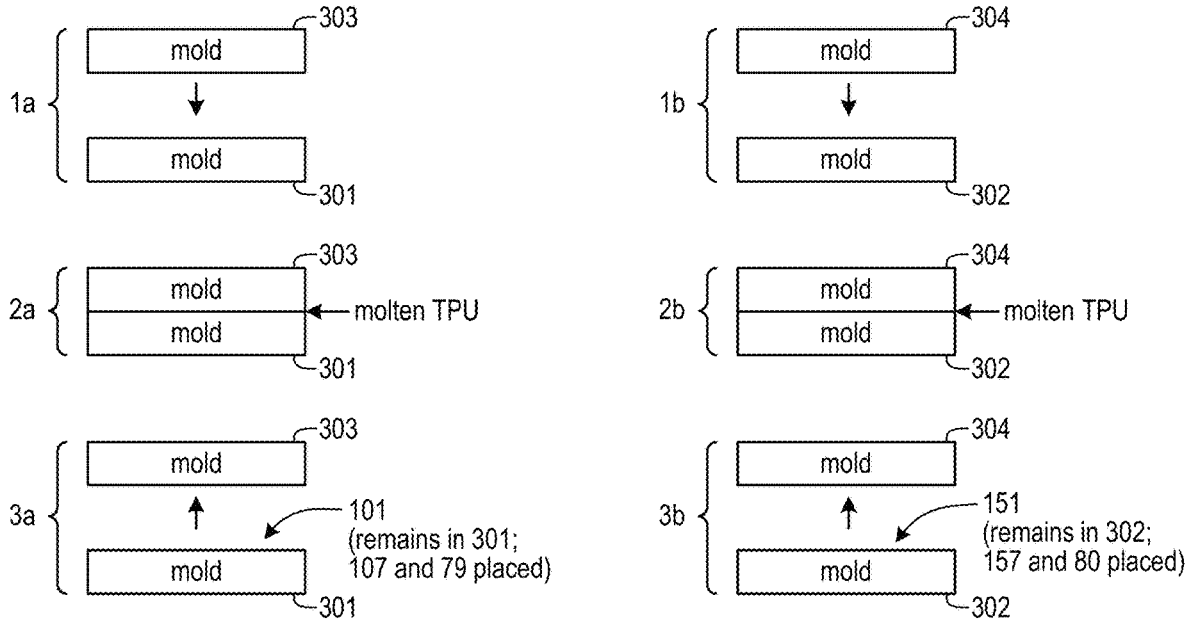
FIGS. 14A and 14B schematically show operations in a process for molding components of an incline adjuster.
Figure 14B:
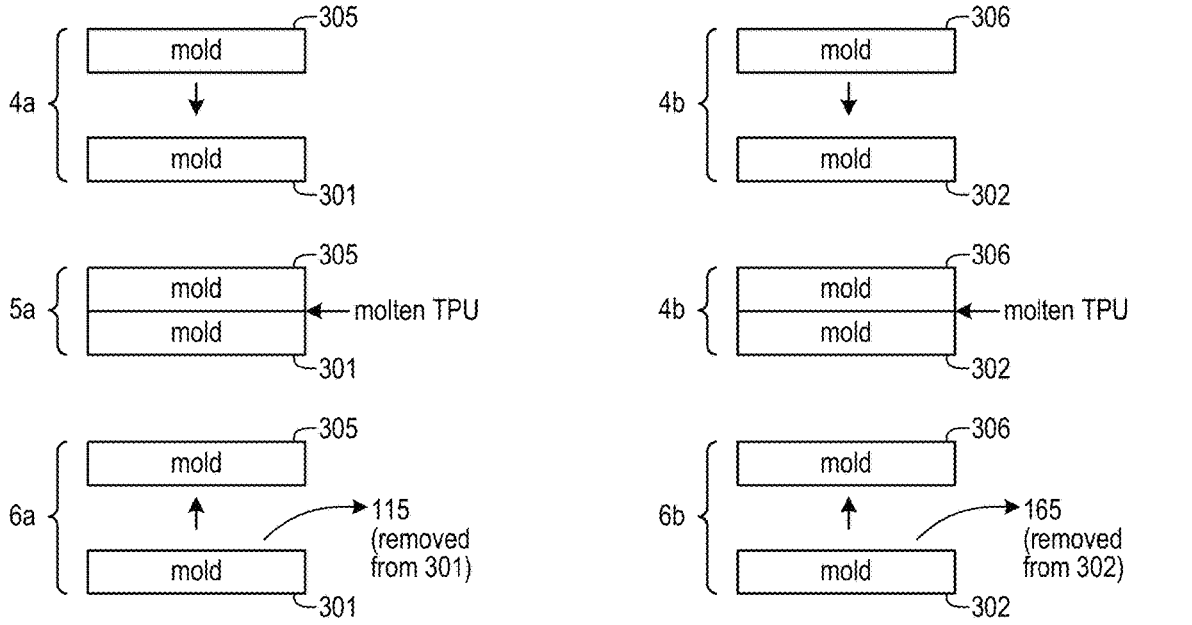

In a second set of operations to form layers 112 and 162 shown in FIG. 14B, bottom molds 301 and 302 and a second set of top molds 305 and 306 are used. A surface on bottom mold 301 has a contour that corresponds to a reverse of, and that will form, the side edge of layer 112. A surface on top mold 305 has a contour that corresponds to a reverse of, and that will form, the top surface of layer 112. In operation (4*a*), molds 301 and 305 are brought together. In operation (5*a*), molten TPU (or other material) is injected, and that material is allowed to harden into layer 112. In operation (6*a*), mold 305 is removed and component 115 is removed from mold 301. A surface on bottom mold 302 has a contour that corresponds to a reverse of, and that will form, the side edge of layer 162. A surface on top mold 306 has a contour that corresponds to a reverse of, and that will form, the bottom surface of layer 162. In operation (4*b*), molds 302 and 306 are brought together. In operation (5*b*), molten TPU (or other material) is injected, and that material is allowed to harden into layer 162. In operation (6*b*), mold 306 is removed and component 165 is removed from mold 302.

In some embodiments, walls 53 of chambers 35 and walls 54 of chambers 36 are molded at the same time as other portions of layer 151. In particular, mold 302 may include regions that have contours corresponding to reverses of the outer surfaces of walls 53 and 54, and mold 304 may include regions that have contours corresponding to reverses of the inner surfaces of walls 53 and 54. In other embodiments, walls 53 and 54 are molded separately. Those walls are then inserted into a bottom mold, a top mold is placed over that bottom mold, and the remainder of layer 151 is injected molded into place around walls 53 and 54. In some such embodiments, bottom and top molds may have removable inserts that are positioned to hold walls 53 and 54. Those inserts may then be replaced with other inserts to form versions of a layer 151 having different sizes and/or shapes of chamber walls.

Figure 14C:
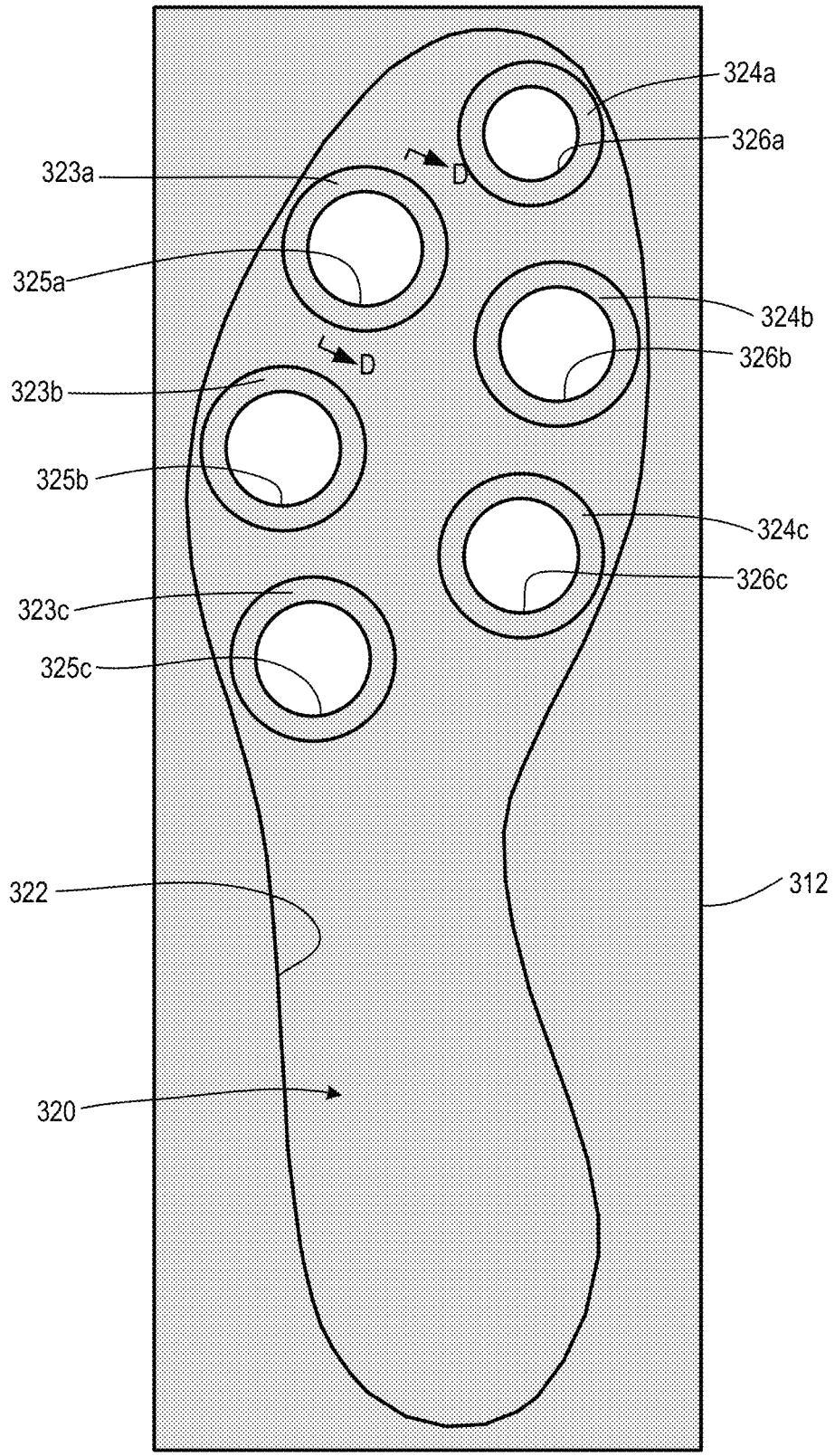
FIGS. 14C and 14D are top views of a mold for forming an incline adjuster according to another embodiment.

FIG. 14C is a top view of a mold 312 according to some embodiments and which may be used to form layer 151. Mold 312 replaces mold 302. Mold 312 includes a bottom surface 320 having a contour that corresponds to a reverse of, and that will form, the top surface of layer 151. Side wall 322 has a contour that corresponds to reverses of, and that will form, the side edges of layers 151 and 162. Inserts 323*a* through 323*c* correspond to walls 53*a* through 53*c*, respectively. Each of inserts 323 has an inner surface (325*a*, 325*b*, and 325*c*) that will contact an outer surface of a wall 53 so as to help retain that wall 53 in place during injection molding. Inserts 324*a* through 324*c* correspond to walls 54*a* through 54*c*, respectively. Each of inserts 324 has an inner surface (326*a*, 325*b*, and 325*c*) that will contact an outer surface of a wall 54 so as to help retain that wall 54 in place during injection molding.

Figure 14D:
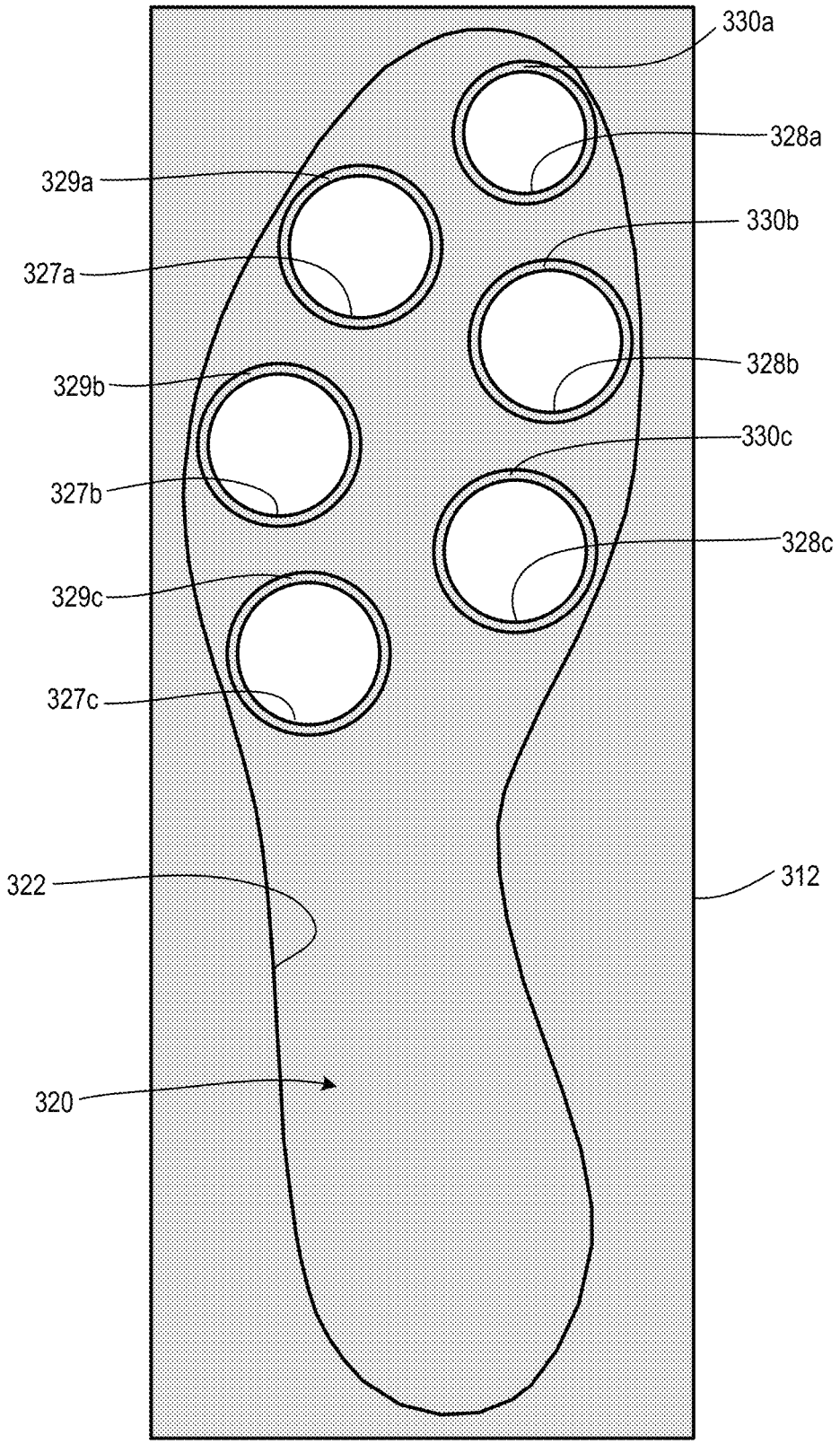

FIG. 14D is a top view of mold 312 with inserts 323 and 324 removed. As explained in more detail below, any or all of inserts 323 and/or any or all of inserts 324 may be replaced with an insert corresponding to a different type of chamber wall, thereby allowing use of mold 312 to create customized versions of an incline adjuster upper component. Opening 327*a* corresponds to insert 323*a* and includes a lip 329*a*. Openings 327*b* and 327*c*, which respectively correspond to inserts 327*b* and 327*c*, include lips 329*a* and 329*b*. Openings 328*a* through 328*c* respectively correspond to inserts 324*a* through 324*c* and include respective lips 330*a* through 330*c*. Lips 329 and 330 help to retain inserts 323 and 324, as described in more detail below.

Figure 15A:
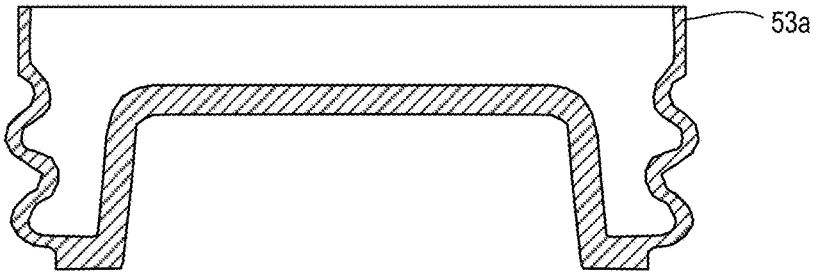
FIGS. 15A through 15F are partially schematic area cross-sectional views showing a first example of molding an incline adjuster component using the mold of FIGS. 14C and 14D.
Figure 15B:
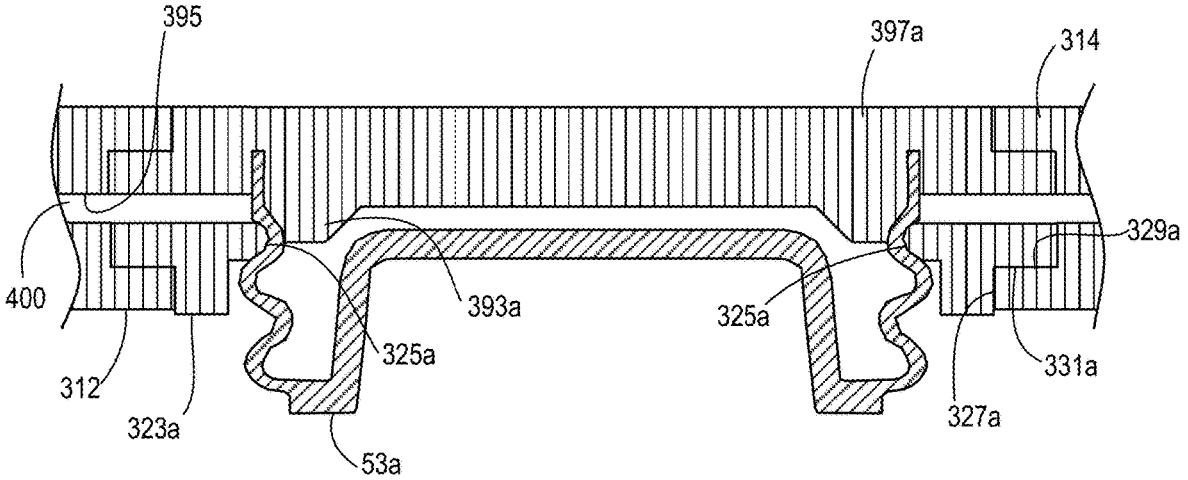
Figure 15C:
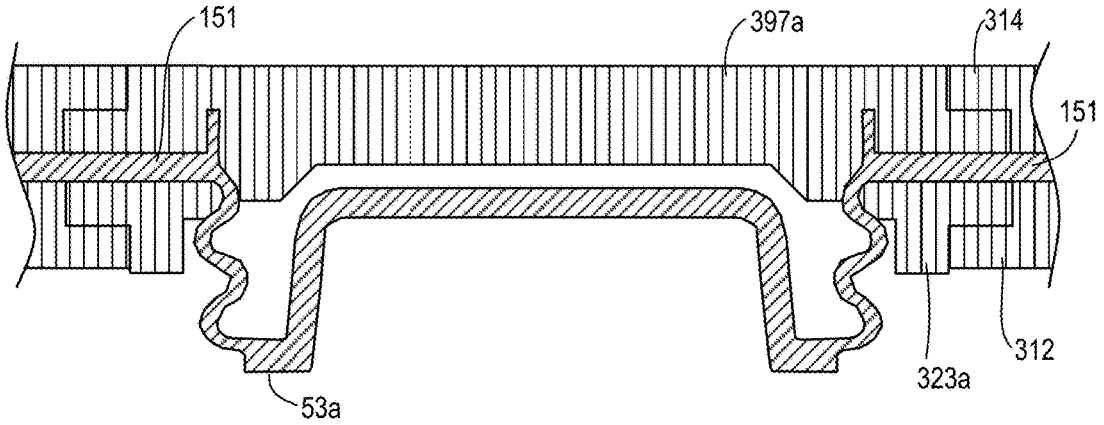
Figure 15D:
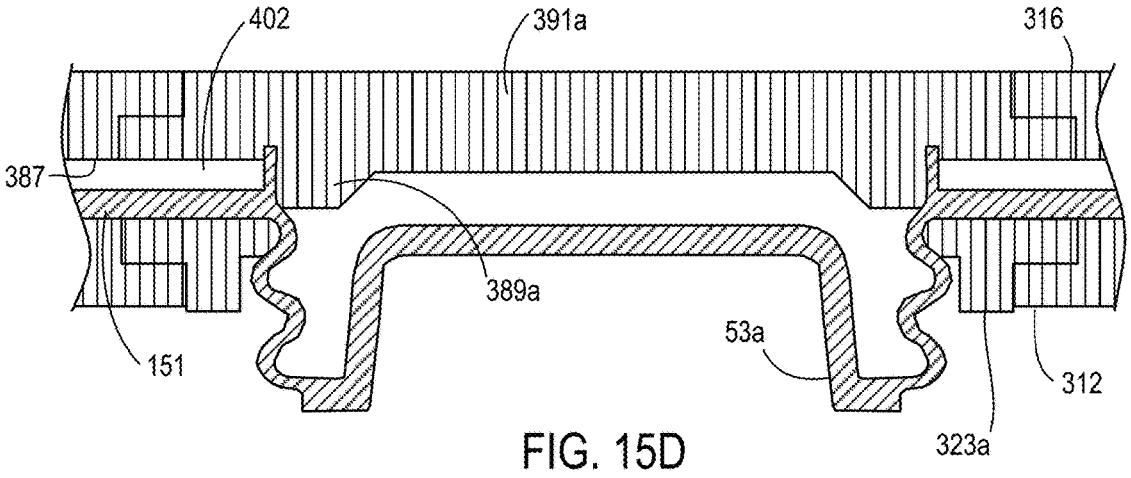
Figure 15E:
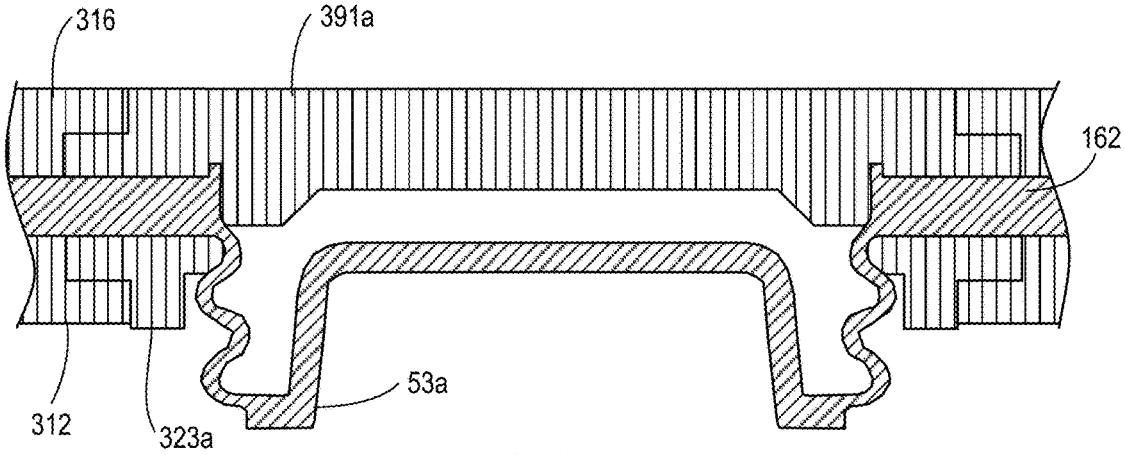
Figure 15F:
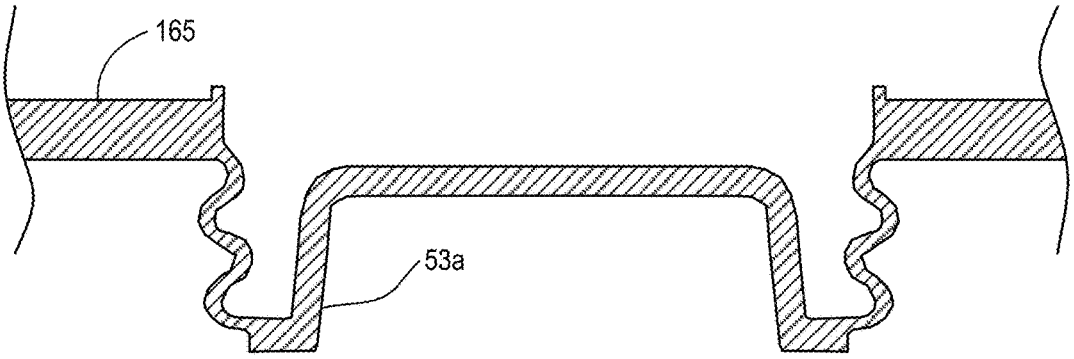

FIGS. 15A through 15F are partially schematic area cross-sectional views showing molding of a portion of component 165 using mold 312. The sectioning plane of FIG. 15A is a vertical plane through the center of wall 53*a*. The sectioning plane of FIGS. 15B through 15E is indicated by arrows D-D in FIG. 14C. The sectioning plane of FIG. 15F is through a portion of component 165 corresponding to the region of mold 312 in which arrows D-D are shown.

FIGS. 15A through 15F correspond to molding a region of component 165 that will surround and incorporate wall 53*a*. Based on the discussion herein, however, persons of ordinary skill will readily appreciate the structure and use of other mold elements to simultaneously mold the portions of component 165 that will surround and incorporate other walls 53 and walls 54.

FIG. 15A is an area cross-sectional view of a wall 53*a* that has been separately molded. FIG. 15B is an area cross-sectional view of wall 53*a* after placement into insert 323*a*.

A top mold 314 is used instead of mold 304 (FIG. 14A) and has been placed over mold 312. Similar to mold 312, mold 314 includes a plurality of inserts that each corresponds to one wall 53 or one wall 54. Insert 397*a*, shown in FIG. 15B, corresponds to wall 53*a*. Other inserts correspond to walls 53*b*, 53*c*, and 54*a* through 54*c*. A surface 395 surrounding insert 397*a* and the inserts corresponding to the other walls 53 and 54 has a contour that corresponds to a reverse of, and that will form, the bottom surface of layer 151 (e.g., including raised region 156). Lip 331*a* of insert 323*a* rests against lip 329*a* of opening 327*a* to secure insert 323*a* in place against outward pressure from injected molten material. Insert 397*a* similarly includes a lip that rests against a lip in an opening of mold 314 to secure insert 323*a* in place against outward pressure from injected molten material. Other inserts of molds 312 and 314 are secured in the same way.

Molds 312 and 314 are joined to define a void 400 into which molten material will be injected. Surface 325*a* of insert 323*a* contacts the outer surface of wall 53*a*. Outer sides of a projection 393*a* in insert 397*a* contact the inner surface of wall 53*a*. In this manner, wall 53*a* is pinched between inserts 323*a* and 325*a* to seal the void 400 around wall 53*a*. Void 400 is similarly sealed around other walls 53 and around walls 54.

FIG. 15C shows molds 312 and 314 after injection of molten material into void 400. The molten material has fused with wall 53*a* and solidified to form layer 151. In FIG. 15D, mold 314 has been removed and layer 151 left in mold 312. Electrode 157 and lead 80 have been put into place on layer 151 (not shown). A second mold 316 is used instead of mold 306 (FIG. 14B) and has been placed over mold 312. Molds 316 and 312, when joined with a layer 151, electrode 157 and lead 80 in mold 312, define a void 402 into which molten material will be injected to form layer 162. Mold 316 includes an insert 391*a* corresponding to wall 53*a* and other inserts correspond to walls 53*b*, 53*c*, and 54*a* through 54*c*. Inserts in mold 316 are also removable and held in place with abutting lips in a manner similar to that described previously. A surface 387 surrounding the inserts in mold 316 has a contour that corresponds to a reverse of, and that will form, the bottom surface of layer 162 (e.g., including transfer channel portions 61.2 through 65.2). A projection 389*a* of insert 391*a* pinches wall 53*a* against insert 323*a* to seal the void 402 around wall 53*a*. Void 402 is similarly sealed around other walls 53 and around walls 54.

FIG. 15E shows molds 312 and 316 after injection of molten material into void 402. The molten material has fused with wall 53*a* and layer 151 and solidified to form layer 162 and component 165. FIG. 15F shows the region of component 165 around wall 53*a* after removal from mold 312.

FIGS. 16A through 16F illustrate how molds 312, 314 and 316 can be used to mold a customized incline adjuster component. Although FIGS. 16A through 16F provide an example in which wall 53*a* is replaced with a different wall, some or all other chamber walls could also or alternatively be replaced.

Figure 16A:
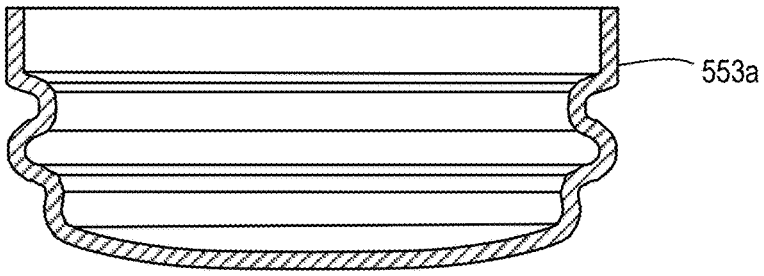
FIGS. 16A through 16F are partially schematic area cross-sectional views showing a second example of molding an incline adjuster component using the mold of FIGS. 14C and 14D.
Figure 16B:
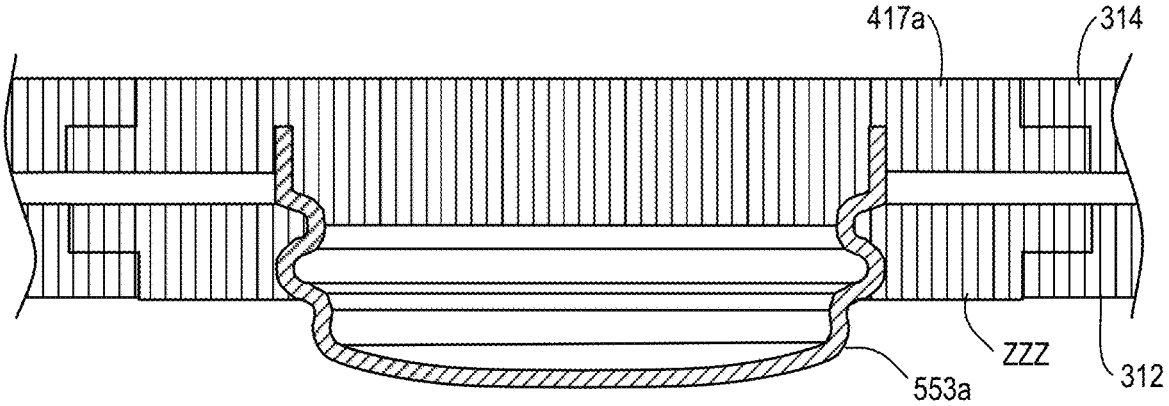
Figure 16C:
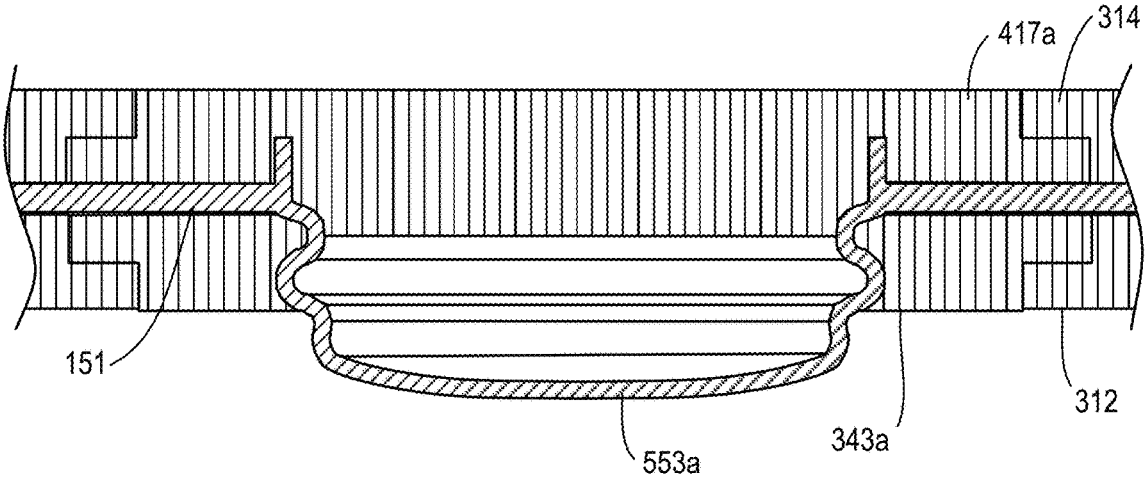
Figure 16D:
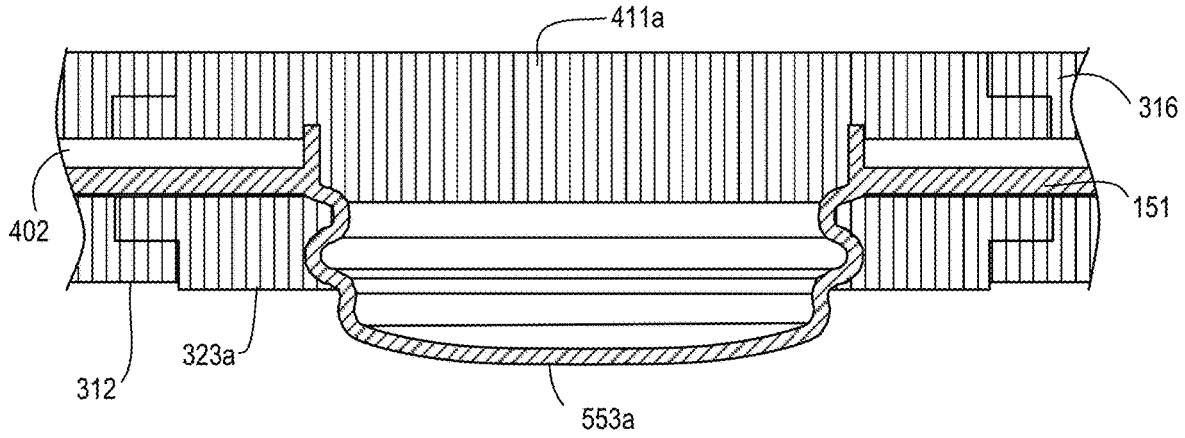
Figure 16E:
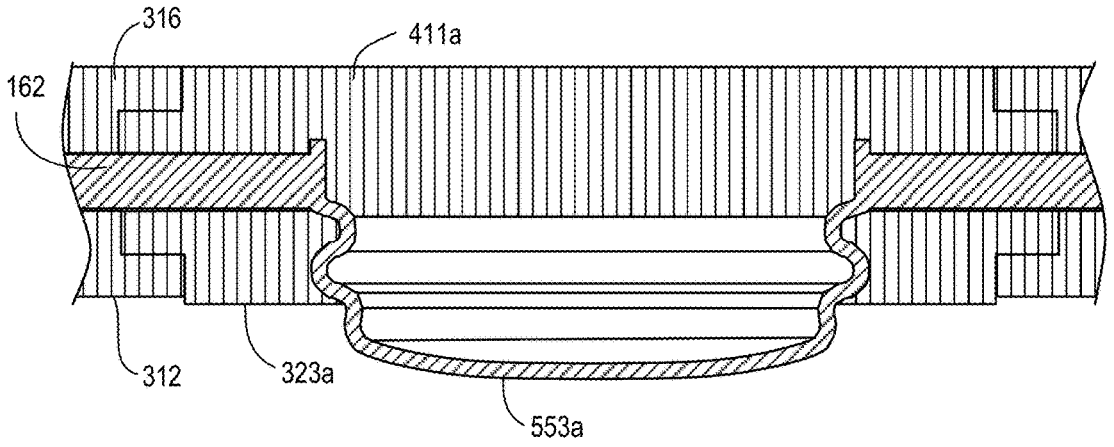
Figure 16F:
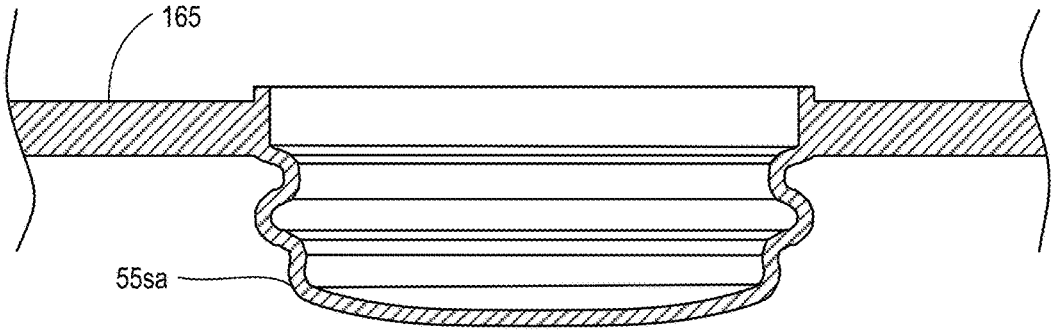

FIG. 16A is an area cross-sectional view of a wall 553*a* that will be used instead of wall 53*a* in an incline adjuster. The sectioning plane is vertical through a diameter of wall 553*a*. The sectioning planes of FIGS. 16B through 16F are from locations similar to those described for FIGS. 15B through 15F. In FIG. 16B wall 553*a* is placed in molds 312 and 314. Inserts 323*a* and 397*a* have been replaced with inserts 343*a* and 417*a*, respectively, that conform to wall 553*a*. In FIG. 16C, molten material has been injected to form layer 151. In FIG. 16D, mold 314 has been removed and replaced with mold 316, with mold 316 now having insert 411*a* (conforming to wall 553*a*) instead of insert 391*a*. Electrode 157 and lead 80 were placed on layer 151 after removal of mold 314 and before placement of mold 316. In FIG. 16E, molten material has been injected to form layer 162 and component 165. FIG. 16F shows the region of component 165 around wall 553*a* after removal from mold 312.

The foregoing description of embodiments has been presented for purposes of illustration and description. The foregoing description is not intended to be exhaustive or to limit embodiments of the present invention to the precise form disclosed, and modifications and variations are possible in light of the above teachings or may be acquired from practice of various embodiments. The embodiments discussed herein were chosen and described in order to explain the principles and the nature of various embodiments and their practical application to enable one skilled in the art to utilize the present invention in various embodiments and with various modifications as are suited to the particular use contemplated. Any and all combinations, subcombinations and permutations of features from herein-described embodiments are the within the scope of the invention. In the claims, a reference to a potential or intended wearer or a user of a component does not require actual wearing or using of the component or the presence of the wearer or user as part of the claimed invention.

The invention claimed is:

1. An article of footwear comprising:

an upper; and a sole structure joined to the upper, the sole structure comprising a base, an incline adjuster, and a support plate, and wherein the base is located in a forefoot portion of the sole structure, a midfoot portion of the sole structure, and a heel portion of the sole structure, the support plate is located in at least the forefoot portion of the sole structure, the incline adjuster comprises an incline adjuster forefoot section located between the base and the support plate in the forefoot portion of the sole structure, the incline adjuster forefoot section comprising at least three chambers, each of the chambers contains an electrorheological fluid and is configured to change outward extension in correspondence to a change in a volume of the electrorheological fluid within the chamber, the chambers are connected in a series by transfer channels, each of the transfer channels permitting flow between two of the chambers, and the transfer channels comprise a flow-regulating transfer channel, the flow-regulating transfer channel comprising opposing first and second electrodes extending along an interior of a field-generating portion of the flow-regulating transfer channel, and the flow-regulating transfer channel and the opposing first and second electrodes extend rearward from a first chamber in the incline adjuster forefoot section to a heel region of the sole structure, and return forward to a second chamber the incline adjuster forefoot section.

2. The article of claim 1, wherein a first of the chambers in the series is not connected to a last of the chambers in the series.

3. The article of claim 1, wherein each of the chambers comprises a flexible wall forming a part of the chamber and that is configured to expand as the volume of the electrorheological fluid within the chamber increases and that is configured to contract as the volume of electrorheological fluid within the chamber decreases.

4. The article of claim 3, wherein the incline adjuster comprises a main body in which the transfer channels are contained and from which the flexible walls of the chambers extend.

5. The article of claim 3, wherein the flexible wall of one of the chambers comprises a central section and a side section surrounding the central section, and the side section comprises at least one fold defining a bellows shape of the chamber.

6. The article of claim 3, wherein the flexible wall of one of the chambers comprises a central section and a side section surrounding the central section, and the central section has an exterior shape that includes a depression.

7. An article of footwear comprising:

an upper; and a sole structure joined to the upper, the sole structure comprising a base, an incline adjuster, and a support plate, and wherein the base is located in a forefoot portion of the sole structure, a midfoot portion of the sole structure, and a heel portion of the sole structure, the support plate is located in at least the forefoot portion of the sole structure, the incline adjuster comprises an incline adjuster forefoot section located between the base and the support plate in the forefoot portion of the sole structure, the incline adjuster forefoot section comprising at least three chambers, each of the chambers contains an electrorheological fluid and is configured to change outward extension in correspondence to a change in a volume of the electrorheological fluid within the chamber, the chambers are connected in a series by transfer channels, each of the transfer channels permitting flow between two of the chambers, and the transfer channels comprise a flow-regulating transfer channel, the flow-regulating transfer channel comprising opposing first and second electrodes extending along an interior of a field-generating portion of the flow-regulating transfer channel, and the sole structure comprises, for each of the chambers, a corresponding chamber cap located between a top of the chamber and a bottom of the support plate.

8. The article of claim 7, wherein each of the chamber caps has a rounded top surface contacting a surface of the bottom of the support plate.

9. The article of claim 8, wherein, for each of the chamber caps, a cap top material forming the rounded top surface has a coefficient of friction, relative to the surface of the bottom of the support plate, that is less than a coefficient of friction, relative to the surface of the bottom of the support plate, of a material forming a top surface of the chamber corresponding to the chamber cap.

10. The article of claim 7, wherein a first of the chambers comprises a flexible wall forming a part of the chamber and that is configured to expand as the volume of electrorheological fluid within the chamber increases and that is configured to contract as the volume of electrorheological fluid within the chamber decreases, the flexible wall of the first chamber comprises a central section and a side section surrounding the central section, the central section of the flexible wall of the first chamber has an exterior shape that includes a depression, and the chamber cap corresponding to the first chamber includes a projection extending into the depression and a skirt surrounding the side section of the flexible wall of the first chamber.

11. The article of claim 1, wherein the transfer channels are configured so that volumes of the electrorheological fluid within the transfer channels remain substantially constant as the volumes of the electrorheological fluid in the chambers vary.

12. The article of claim 1, wherein the chambers comprise one or more medial chambers located on a medial side of the incline adjuster forefoot section and one or more lateral chambers located on a lateral side of the incline adjuster forefoot section.

13. The article of claim 12, wherein the medial chambers comprise a front medial chamber, an intermediate medial chamber, and a rear medial chamber, and the lateral chambers comprise front lateral chamber, an intermediate lateral chamber, and a rear lateral chamber.

14. The article of claim 1, wherein the field-generating portion extends through midfoot and heel regions of the sole structure.

15. The article of claim 1, wherein the field-generating portion has a length L and an average width W, and a ratio L/W is at least 50.

16. The article of claim 1, wherein the transfer channels comprise at least one transfer channel that lacks electrodes.

* * * * *